US010229560B2

(12) United States Patent
Weingardt et al.

(10) Patent No.: US 10,229,560 B2
(45) Date of Patent: Mar. 12, 2019

(54) VIDEO BINGO GAME AND METHOD THEREFOR

(71) Applicant: Gary Weingardt, Las Vegas, NV (US)

(72) Inventors: Gary Weingardt, Las Vegas, NV (US); Gamin Weingardt, Las Vegas, NV (US); Gary L. Loebig, Austin, TX (US)

(73) Assignee: Gary Weingardt, Las Vegas, NV (US)

( * ) Notice: Subject to any disclaimer, the term of this patent is extended or adjusted under 35 U.S.C. 154(b) by 0 days.

(21) Appl. No.: 14/066,117

(22) Filed: Oct. 29, 2013

(65) Prior Publication Data

US 2015/0119128 A1 Apr. 30, 2015

(51) Int. Cl.
*G07F 17/32* (2006.01)

(52) U.S. Cl.
CPC ..... *G07F 17/3276* (2013.01); *G07F 17/3286* (2013.01)

(58) Field of Classification Search
CPC ..... A63F 3/06; A63F 3/062; A63F 3/0645; G07F 17/3276
See application file for complete search history.

(56) References Cited

U.S. PATENT DOCUMENTS 4,856,787 A 8/1989 Itkis
5,393,057 A 2/1995 Marnell
5,611,729 A * 3/1997 Schumacher et al. ..... 463/18
5,823,873 A 10/1998 Moody
6,007,066 A 12/1999 Moody
6,079,711 A * 6/2000 Wei et al. ..... 273/269
6,656,044 B1 * 12/2003 Lewis ..... 463/19
6,722,655 B1 * 4/2004 Camero ..... 273/269
7,566,058 B1 * 7/2009 Itkis ..... 273/269
8,123,607 B2 2/2012 Van Asdale
8,201,827 B2 6/2012 Weingardt
8,752,838 B2 6/2014 Weingardt et al.
2002/0113369 A1 8/2002 Weingardt
2005/0019080 A1 * 1/2005 Pearson ..... B41J 2/2052 400/490
2005/0043079 A1 * 2/2005 Huang ..... 463/19
2005/0059469 A1 * 3/2005 Gail ..... G07F 17/3232 463/19
2005/0059471 A1 * 3/2005 Cannon ..... G07F 17/3267 463/19

(Continued)

*Primary Examiner* — Corbett B Coburn
(74) *Attorney, Agent, or Firm* — Weiss & Moy, P.C.; Karen J. S. Fouts; Veronica-Adele R. Cao

(57) ABSTRACT

A method of operating a video gaming system having program instructions, the programming instructions comprising: providing each player with at least one individual flashboard having suit and value indicia and a game ending pattern outlined thereon; providing a plurality of bingo balls; randomly selecting a first group of bingo balls; displaying to each player the markings associated with each selected bingo ball of the first group of bingo balls; marking each square associated with each of the first group of bingo balls on each individual flashcard; selecting a second group of bingo balls, wherein a total number of bingo balls in the first group and the second group is equal to a least amount of balls needed to completely fill the game ending pattern; displaying to each player the markings associated with each selected bingo ball of the second group of bingo balls; and determining any winning flashboard.

27 Claims, 19 Drawing Sheets

(56) References Cited

U.S. PATENT DOCUMENTS

| | | | | |
|---|---|---|---|---|
| 2005/0064925 | A1* | 3/2005 | Robb | G07F 17/32 463/16 |
| 2006/0025199 | A1* | 2/2006 | Harkins | G07F 17/32 463/19 |
| 2006/0052160 | A1* | 3/2006 | Saffari | G07F 17/32 463/27 |
| 2012/0028696 | A1 | 2/2012 | Gail et al. | |
| 2012/0108310 | A1 | 5/2012 | Hollibaugh et al. | |
| 2013/0053121 | A1* | 2/2013 | Weingardt et al. | 463/19 |
| 2013/0200568 | A1 | 8/2013 | Mahon | |
| 2014/0066163 | A1* | 3/2014 | Mullins et al. | 463/19 |
| 2014/0256393 | A1* | 9/2014 | Navarrete | 463/17 |
| 2014/0274279 | A1* | 9/2014 | Macbeth | G07F 17/32 463/19 |

* cited by examiner

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| 4 OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

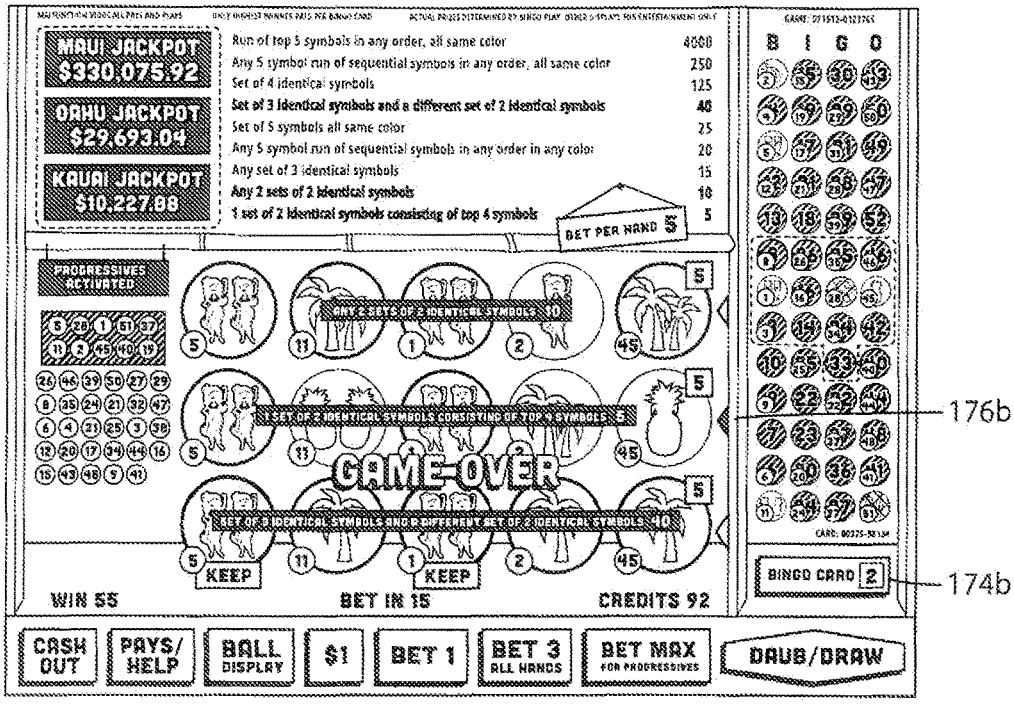
FIG. 17.1
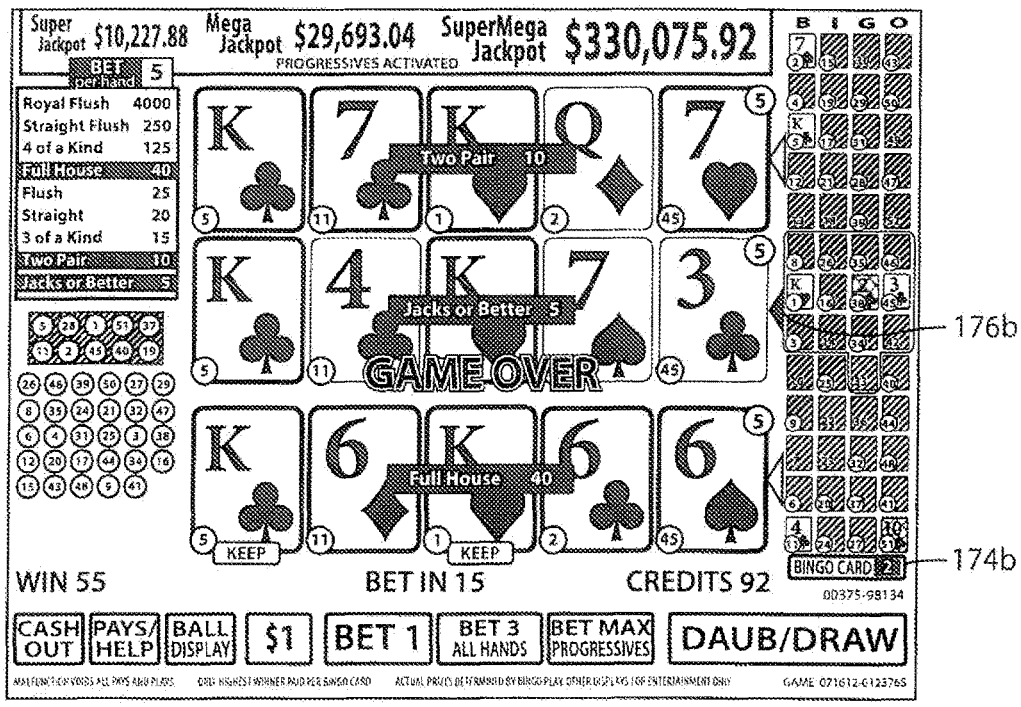
FIG. 17.1a

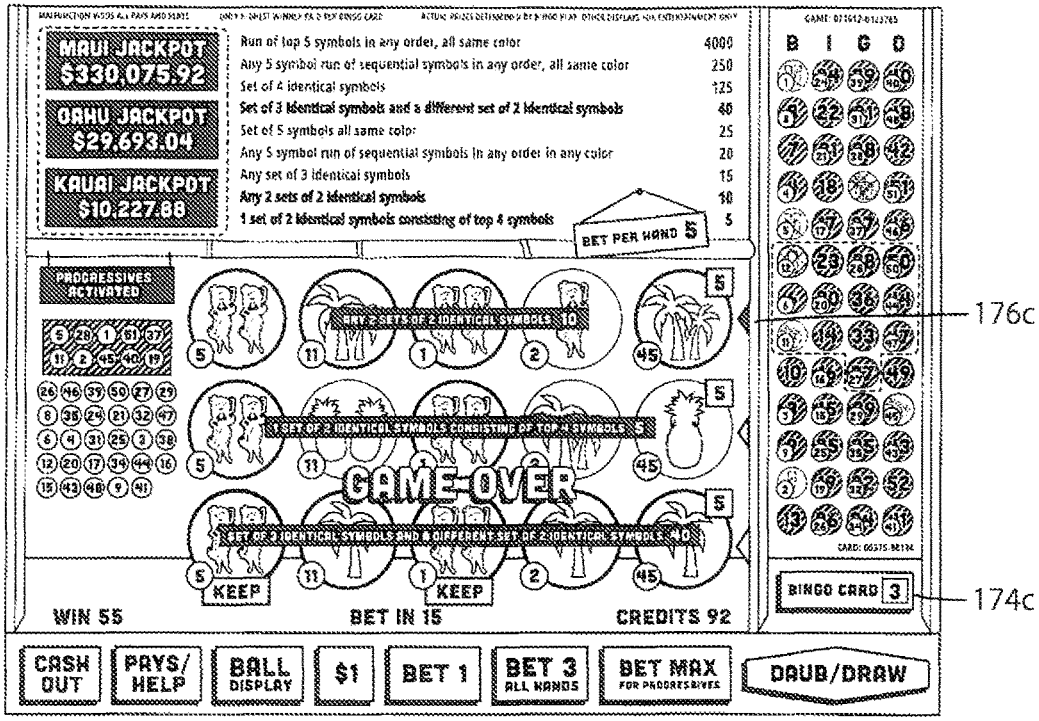
FIG. 17.2
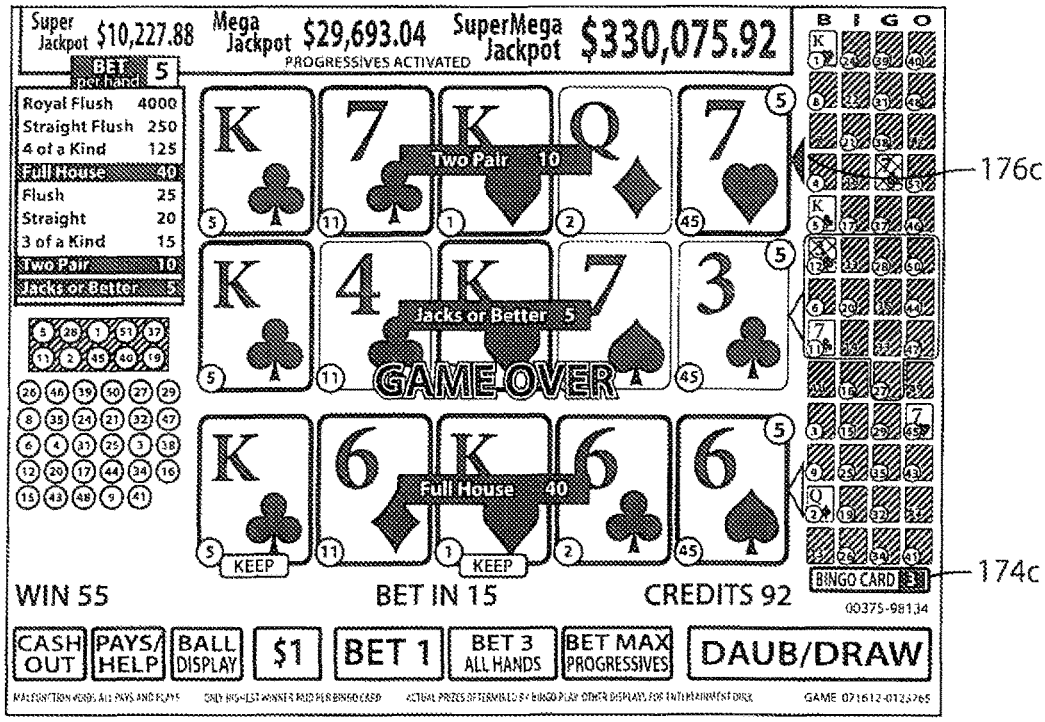
FIG. 17.2a

Bingo Card 1

| | A | B | C | D |
|---|---|---|---|---|
| 1 | 2 | 21 | 30 | 41 |
| 2 | 5 | 14 | 38 | 40 |
| 3 | 8 | 20 | 39 | 49 |
| 4 | 11 | 16 | 34 | 42 |
| 5 | 1 | 22 | 32 | 47 |
| 6 | 7 | 19 | 35 | 45 |
| 7 | 4 | 25 | 29 | 44 |
| 8 | 3 | 17 | 37 | 51 |
| 9 | 13 | 15 | 33 | 50 |
| 10 | 12 | 23 | 27 | 43 |
| 11 | 6 | 26 | 31 | 52 |
| 12 | 10 | 18 | 28 | 46 |
| 13 | 9 | 24 | 36 | 48 |

Poker Overlay 1

| | A | B | C | D |
|---|---|---|---|---|
| 1 | 6C | 7H | QH | 5D |
| 2 | KC | 8S | 10H | AH |
| 3 | 7D | KS | 4D | QS |
| 4 | 6D | 7S | 3D | 8D |
| 5 | KH | 2C | 3H | 10D |
| 6 | 8H | JH | KD | 6S |
| 7 | QC | 5H | 5C | 7C |
| 8 | JS | 4H | 4C | 2D |
| 9 | 10S | 9H | AS | 10C |
| 10 | 2H | JD | AC | 9C |
| 11 | 2S | 5S | AD | 9D |
| 12 | QD | 6H | 8C | 3C |
| 13 | 9S | 4S | JC | 3S |

Bingo Card 2

| | A | B | C | D |
|---|---|---|---|---|
| 1 | 2 | 15 | 30 | 43 |
| 2 | 4 | 19 | 29 | 50 |
| 3 | 5 | 17 | 31 | 49 |
| 4 | 12 | 21 | 28 | 47 |
| 5 | 13 | 18 | 39 | 52 |
| 6 | 8 | 26 | 35 | 46 |
| 7 | 1 | 16 | 38 | 45 |
| 8 | 3 | 14 | 34 | 42 |
| 9 | 10 | 25 | 33 | 40 |
| 10 | 9 | 22 | 36 | 44 |
| 11 | 7 | 23 | 32 | 48 |
| 12 | 6 | 20 | 37 | 41 |
| 13 | 11 | 24 | 27 | 51 |

Poker Overlay 2

| | A | B | C | D |
|---|---|---|---|---|
| 1 | 7S | QS | 8C | 8H |
| 2 | 8S | 8D | 3S | 4D |
| 3 | 2C | AC | 5S | KD |
| 4 | 2S | AS | KS | 9S |
| 5 | 10D | 10C | 9C | 3H |
| 6 | QD | 6H | QC | 5C |
| 7 | 10S | QH | KC | 3C |
| 8 | 4S | JS | 6S | 3D |
| 9 | 5H | 4H | 5D | 10H |
| 10 | 2D | 7C | 6D | 2H |
| 11 | JD | JC | JH | AH |
| 12 | 6C | 9D | 7H | 9H |
| 13 | 4C | 7D | AD | KH |

Bingo Card 3

| | A | B | C | D |
|---|---|---|---|---|
| 1 | 1 | 24 | 39 | 40 |
| 2 | 8 | 22 | 31 | 48 |
| 3 | 7 | 21 | 38 | 42 |
| 4 | 4 | 18 | 30 | 51 |
| 5 | 5 | 17 | 37 | 46 |
| 6 | 12 | 23 | 28 | 50 |
| 7 | 6 | 20 | 36 | 44 |
| 8 | 11 | 14 | 33 | 47 |
| 9 | 10 | 16 | 27 | 49 |
| 10 | 3 | 15 | 29 | 45 |
| 11 | 9 | 25 | 35 | 43 |
| 12 | 2 | 19 | 32 | 52 |
| 13 | 13 | 26 | 34 | 41 |

Poker Overlay 3

| | A | B | C | D |
|---|---|---|---|---|
| 1 | 7S | 10S | AC | 5H |
| 2 | 5D | 6D | 9H | 3S |
| 3 | 8D | QS | AH | 6S |
| 4 | 2S | 2D | KH | 5S |
| 5 | 3C | 10C | 9D | 9C |
| 6 | KC | 4D | QH | 9S |
| 7 | 2C | 4C | 6C | 7D |
| 8 | 7C | 8C | AS | 8H |
| 9 | KS | 3H | 10D | JS |
| 10 | JC | 10H | 2H | 7H |
| 11 | QC | JH | 4S | AD |
| 12 | QD | JD | 6H | 4H |
| 13 | 8S | 5C | 3D | KD |

FIG. 19

Bingo Card 1

| | A | B | C | D |
|---|---|---|---|---|
| 1 | 2 | 21 | 30 | 41 |
| 2 | 5 | 14 | 38 | 40 |
| 3 | 8 | 20 | 39 | 49 |
| 4 | 11 | 16 | 34 | 42 |
| 5 | 1 | 22 | 32 | 47 |
| 6 | 7 | 19 | 35 | 45 |
| 7 | 4 | 25 | 29 | 44 |
| 8 | 3 | 17 | 37 | 51 |
| 9 | 13 | 15 | 33 | 50 |
| 10 | 12 | 23 | 27 | 43 |
| 11 | 6 | 26 | 31 | 52 |
| 12 | 10 | 18 | 28 | 46 |
| 13 | 9 | 24 | 36 | 48 |

Poker Overlay 1

| | A | B | C | D |
|---|---|---|---|---|
| 1 | 6C | 7H | QH | 5D |
| 2 | KC | 8S | 10H | AH |
| 3 | 7D | KS | 4D | QS |
| 4 | 6D | 7S | 3D | 8D |
| 5 | KH | 2C | 3H | 10D |
| 6 | 8H | JH | KD | 6S |
| 7 | QC | 5H | 5C | 7C |
| 8 | JS | 4H | 4C | 2D |
| 9 | 10S | 9H | AS | 10C |
| 10 | 2H | JD | AC | 9C |
| 11 | 2S | 5S | AD | 9D |
| 12 | QD | 6H | 8C | 3C |
| 13 | 9S | 4S | JC | 3S |

180

182

184

FIG. 20

186

Bingo Card 2

| | A | B | C | D |
|---|---|---|---|---|
| 1 | 2 | 15 | 30 | 43 |
| 2 | 4 | 19 | 29 | 50 |
| 3 | 5 | 17 | 31 | 49 |
| 4 | 12 | 21 | 28 | 47 |
| 5 | 13 | 18 | 39 | 52 |
| 6 | 8 | 26 | 35 | 46 |
| 7 | 1 | 16 | 38 | 45 |
| 8 | 3 | 14 | 34 | 42 |
| 9 | 10 | 25 | 33 | 40 |
| 10 | 9 | 22 | 36 | 44 |
| 11 | 7 | 23 | 32 | 48 |
| 12 | 6 | 20 | 37 | 41 |
| 13 | 11 | 24 | 27 | 51 |

Poker Overlay 2

| | A | B | C | D |
|---|---|---|---|---|
| 1 | 7S | QS | 8C | 8H |
| 2 | 8S | 8D | 3S | 4D |
| 3 | 2C | AC | 5S | KD |
| 4 | 2S | AS | KS | 9S |
| 5 | 10D | 10C | 9C | 3H |
| 6 | QD | 6H | QC | 5C |
| 7 | 10S | QH | KC | 3C |
| 8 | 4S | JS | 6S | 3D |
| 9 | 5H | 4H | 5D | 10H |
| 10 | 2D | 7C | 6D | 2H |
| 11 | JD | JC | JH | AH |
| 12 | 6C | 9D | 7H | 9H |
| 13 | 4C | 7D | AD | KH |

Bingo Card 3

| | A | B | C | D |
|---|---|---|---|---|
| 1 | 1 | 24 | 39 | 40 |
| 2 | 8 | 22 | 31 | 48 |
| 3 | 7 | 21 | 38 | 42 |
| 4 | 4 | 18 | 30 | 51 |
| 5 | 5 | 17 | 37 | 46 |
| 6 | 12 | 23 | 28 | 50 |
| 7 | 6 | 20 | 36 | 44 |
| 8 | 11 | 14 | 33 | 47 |
| 9 | 10 | 16 | 27 | 49 |
| 10 | 3 | 15 | 29 | 45 |
| 11 | 9 | 25 | 35 | 43 |
| 12 | 2 | 19 | 32 | 52 |
| 13 | 13 | 26 | 34 | 41 |

Poker Overlay 3

| | A | B | C | D |
|---|---|---|---|---|
| 1 | 7S | 10S | AC | 5H |
| 2 | 5D | 6D | 9H | 3S |
| 3 | 8D | QS | AH | 6S |
| 4 | 2S | 2D | KH | 5S |
| 5 | 3C | 10C | 9D | 9C |
| 6 | KC | 4D | QH | 9S |
| 7 | 2C | 4C | 6C | 7D |
| 8 | 7C | 8C | AS | 8H |
| 9 | KS | 3H | 10D | JS |
| 10 | JC | 10H | 2H | 7H |
| 11 | QC | JH | 4S | AD |
| 12 | QD | JD | 6H | 4H |
| 13 | 8S | 5C | 3D | KD |

186

188

188

FIG. 21

| WINNING COMBINATION | PRIZE PER WAGER/BUY-IN | | | | |
|---|---|---|---|---|---|
| | 1 Credit | 2 Credits | 3 Credits | 4 Credits | 5 Credits |
| Maui Jackpot Progressive<br>No squares marked in pattern | Progressive Prize Amount paid on "MAX BET ONLY" | | | | Prog. Prize Amt |
| Oahu Jackpot Progressive<br>Only one square marked in pattern | Progressive Prize Amount paid on "MAX BET ONLY" | | | | Prog. Prize Amt |
| Kauai Jackpot Progressive<br>Only two squares marked in pattern | Progressive Prize Amount paid on "MAX BET ONLY" | | | | Prog. Prize Amt |
| "Run of top 5 symbols in any order, all same color" | 250 | 500 | 750 | 1000 | 4000 |
| "Any 5 symbol run of sequential symbols in any order, all same color" | 50 | 100 | 150 | 200 | 250 |
| "Set of 4 identical symbols" | 25 | 50 | 75 | 100 | 125 |
| "Set of 3 identical symbols and a different set of 2 identical symbols" | 8 | 16 | 24 | 32 | 40 |
| "Set of 5 symbols all same color" | 5 | 10 | 15 | 20 | 25 |
| "Any 5 symbol run of sequential symbols in any order in any color" | 4 | 8 | 12 | 16 | 20 |
| "Any set of 3 identical symbols" | 3 | 6 | 9 | 12 | 15 |
| "Any 2 sets of 2 identical symbols" | 2 | 4 | 6 | 8 | 10 |
| "1 set of 2 identical symbols consisting of top 4 symbols" | 1 | 2 | 3 | 4 | 5 |
| Game Ending Pattern<br>Block of 12 Plus One | Game Ending Prize Amount | | | | |

FIG. 25

| WINNING COMBINATION | PRIZE PER WAGER/BUY-IN | | | | |
|---|---|---|---|---|---|
| | 1 Credit | 2 Credits | 3 Credits | 4 Credits | 5 Credits |
| Mega Jackpot Progressive<br>No squares marked in pattern | Progressive Prize Amount paid on "MAX BET ONLY" | | | | Prog. Prize Amt |
| Super Jackpot Progressive<br>Only one square marked in pattern | Progressive Prize Amount paid on "MAX BET ONLY" | | | | Prog. Prize Amt |
| Jackpot Progressive<br>Only two squares marked in pattern | Progressive Prize Amount paid on "MAX BET ONLY" | | | | Prog. Prize Amt |
| "Royal Flush" | 250 | 500 | 750 | 1000 | 4000 |
| "Straight Flush" | 50 | 100 | 150 | 200 | 250 |
| "4 of a Kind" | 25 | 50 | 75 | 100 | 125 |
| "Full House" | 8 | 16 | 24 | 32 | 40 |
| "Flush" | 5 | 10 | 15 | 20 | 25 |
| "Straight" | 4 | 8 | 12 | 16 | 20 |
| "3 of a Kind" | 3 | 6 | 9 | 12 | 15 |
| "2 Pair" | 2 | 4 | 6 | 8 | 10 |
| "Jacks or Better" | 1 | 2 | 3 | 4 | 5 |
| Game Ending Pattern<br>Block of 12 Plus One | Game Ending Prize Amount | | | | |

FIG. 25a

VIDEO BINGO GAME AND METHOD THEREFOR

RELATED APPLICATIONS

This is related to U.S. patent application Ser. No. 13/495,259, filed Jun. 13, 2012 which is a continuation-in-part of U.S. patent application Ser. No. 09/949,311, filed Sep. 7, 2001 which is a continuation-in-part of U.S. patent application Ser. No. 09/745,706, filed Dec. 26, 2000 in the name of the Applicant.

BACKGROUND

This invention relates generally to bingo games, and more particularly to a video bingo game and method that utilizes bingo rules to present video games having the look and feel of video poker and slot games, and that preferably utilize multiple ball draws to provide a pace of play beneficial to fast and slow players alike.

The rules of play for conventional bingo are well-known. Players receive individual game cards, generally featuring a matrix of five rows and five columns. The columns are lettered BINGO from left to right across the top of the matrix and each bingo card has five numbers in each row, except for the center I column which has a "free space" at the intersection of the third row and the third column.

Bingo balls individually numbered 1-75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" or hits the bingo button and he wins the game.

Bingo is increasingly being played in electronic form. Players operate linked machines that display one or more bingo cards. Numbers are called by live ball draw, or a bonanza game and the called numbers are daubed on the player cards on each linked machine. Each game is played until a winning card on at least one linked machine is produced, after which another game may be started.

But there are a number of drawbacks associated with prior art electronic bingo games. Many players prefer the fast action of video poker and slot machines to relatively slower traditional bingo games. Such players will tend to avoid electronic bingo games entirely, in favor of competing games.

Moreover, even for those who prefer to play bingo, prior art video bingo games are not entirely satisfactory. One drawback is timing. Depending on the player, the game may be too fast or too slow. Thus, each game will have a single ball draw and a time limit, perhaps in the range of about 20 seconds. A fast player might be able in significantly less than the allotted time to complete his or her selections and be ready to play the next game—only to be forced to wait until the game has closed and the next one begun with another ball draw. After a series of games, a player who is required to spend a significant time waiting may well opt to leave the machine and choose a faster-paced game.

On the other hand, a slower player might find that he or she cannot make the required selections in time, with the result that the game closes before they have finished. Players who cannot finish the game in the allotted time can also be expected to lose interest.

A need therefore existed for an electronic bingo game having the look and feel of a non-bingo game, including for example video poker or video slots (sometimes also referred to as "fruit machines"). A need further existed for an electronic bingo game that accommodates the play habits of both fast and slow players. The present invention satisfies these needs and provides other, related, advantages.

SUMMARY OF THE INVENTION

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

A method of operating a video gaming system, wherein said video gaming system has a processor for executing program instructions and a memory coupled to the processor for storing the program instructions, the programming instructions comprising: displaying on a screen of a terminal of the video game system a combination bingo and poker video game; providing each player with at least one individual flashboard, each flashboard having an equal number of spaces, each space defined by a column label and a space number, wherein the space number is randomly selected from a predefined number range for each column, wherein the individual flashboard has indicia for each space on each flashboard, wherein the indicia comprises each of suit and value indicia, the individual flashboard having a game ending pattern outlined thereon; providing a plurality of bingo balls for common use for all players, wherein each bingo ball has markings associated with one of the plurality of spaces, a total number of bingo balls corresponding to a number of the plurality of spaces on an individual flashboard; randomly selecting a first group of bingo balls for common use for all players; displaying to each player the markings associated with each selected bingo ball of the first group of bingo balls; marking each square associated with each of the first group of bingo balls on each individual flashboard; randomly selecting a second group of bingo balls for common use for all players, wherein a total number of bingo balls in the first group of bingo balls and the second group of bingo balls is equal to a least amount of balls needed to completely fill the game ending pattern; displaying to each player the markings associated with each selected bingo ball of the second group of bingo balls; and determining any winning flashboard.

A method of operating a video gaming system, wherein said video gaming system has a processor for executing program instructions and a memory coupled to the processor for storing the program instructions, the programming instructions comprising: displaying on a screen of a terminal of the video game system a combination bingo and poker video game; providing each player with a plurality of individual flashboards, each flashboard having an equal number of spaces, each space defined by a column label and a space number, wherein the space number is randomly selected from a predefined number range for each column, wherein the individual flashboard has indicia for each space on each flashboard, wherein the indicia comprises each of suit and value indicia, the individual flashboard having a game ending pattern outlined thereon; providing a plurality of bingo balls for common use for all players, wherein each bingo ball has markings associated with one of the plurality of spaces, a total number of bingo balls corresponding to a number of the plurality of spaces on an individual flashboard; randomly selecting a first group of bingo balls for common use for all players; displaying to each player the markings associated with each selected bingo ball of the first group of bingo balls; marking each square associated with each of the first group of bingo balls on each of the plurality of individual flashboard; randomly selecting a second group of bingo balls for common use for all players, wherein a total number of bingo balls in the first group of bingo balls and the second group of bingo balls is equal to a least amount of balls needed to completely fill the game ending pattern; displaying to each player the markings associated with each selected bingo ball of the second group of bingo balls; and determining any winning flashboards.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein:

FIG. 17.1 shows a front view of a final game state depicting winning bonus poker hands of a second bingo card;

FIG. 17.1*a* shows another embodiment of a front view of a final game state depicting winning bonus poker hands of a second bingo card;

FIG. 17.2 shows a front view of a final game state depicting winning bonus poker hands of a third bingo card;

FIG. 17.2*a* shows another embodiment of a front view of a final game state depicting winning bonus poker hands of a third bingo card;

FIG. 19 shows the bingo cards and associated overlay cards at the beginning of the game depicted in FIGS. 16, 17, and 18;

FIG. 20 bingo card 1 and associated overlay card depicted after player keep/swap decision, corresponds with FIG. 16;

FIG. 21 bingo cards 2 and 3 along with their associated overlay cards after player keep/swap decision;

FIG. 25 shows a winning arrangement/combination table; and

FIG. 25*a* shows another embodiment of a winning arrangement/combination table.

DETAILED DESCRIPTION

Referring first to FIGS. 1-4, an embodiment of the bingo game of the present invention having the look and feel of video poker is shown. For ease of reference, this game will be referred to as "Bingo Poker" herein.

Figure 4:
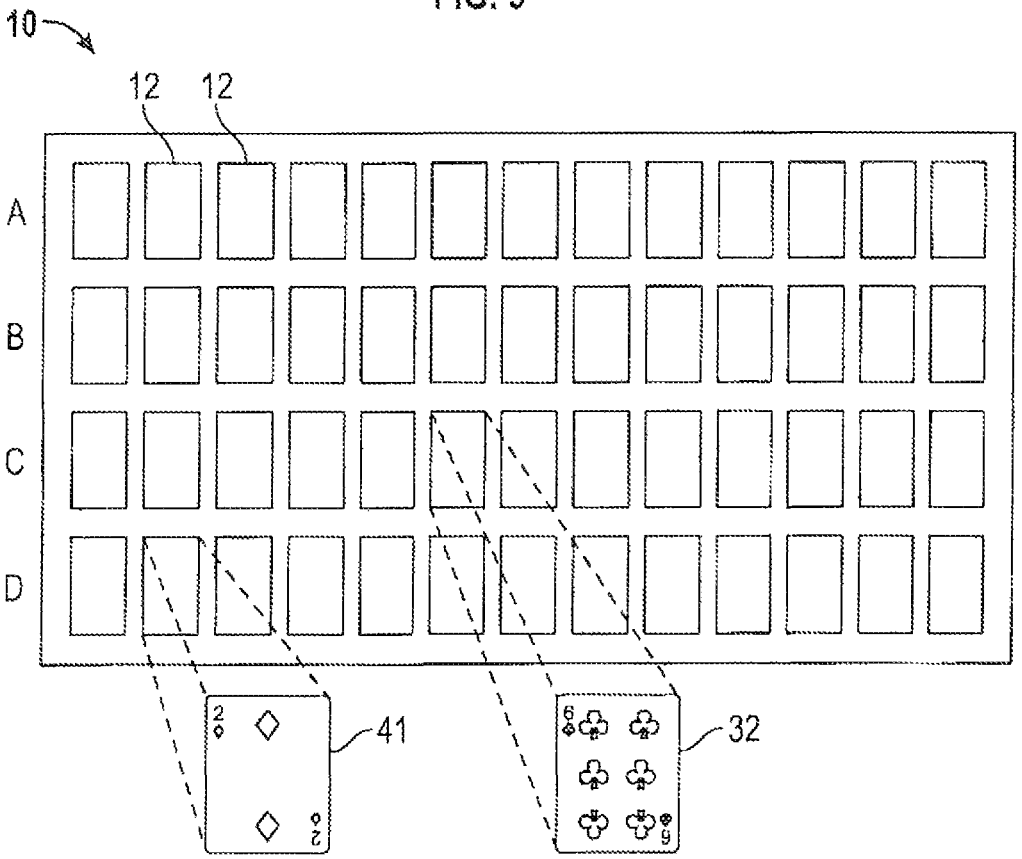
FIG. 4 shows a flashboard component of an embodiment of a bingo game of the present invention, with two flashboard squares shown in detail.

Referring first to FIG. 4, each player is provided with a flashboard/bingo card 10 (hereinafter "flashboard 10"). The flashboard 10 may optionally be displayed to the player on a video screen, or may simply be provided to the game terminal but not displayed. In order to provide a less cluttered appearance, and to enhance the poker-like look of the game, it will be preferred to not display the flashboard 10 on the gaming machine screen.

In its preferred configuration, the flashboard 10 contains a plurality of individual squares 12. Each square 12 is intended to correspond to a particular numbered ball used in the game, with the total number of squares corresponding to the total number of numbered balls used. As shown in FIG. 4, in this embodiment, there are 52 squares 12, corresponding to 52 balls. As will be discussed below, it will be possible to vary the number of squares 12 and balls, and indeed, it would be possible to provide a noncorresponding number of squares 12 and balls.

It should be noted further that if the flashboard 10 is to be displayed to the player, the configuration shown in FIG. 4—having four rows of thirteen squares each, with, reading from left to right, row A having squares 1-13, row B having squares 14-26, row C having squares 27-39, and row D having squares 40-52—is only one of many that would be possible. Thus, it would be possible to organize the squares 12 into any desired combination of rows and columns or other display arrangement.

Preferably, each individual square 12 has assigned thereto appropriate indicia corresponding to the specific game that is to be played. For Bingo Poker, the indicia will comprise suit and value indicia commonly displayed on playing cards. For example, as shown in FIG. 4, square 32 has been assigned as its suit and value indicia the six of clubs. Square 41 has been assigned as its suit and value indicia the two of diamonds. In a Bingo Poker game that utilizes 52 balls and thus at least 52 squares 12, each square 12 will have different suit and value indicia, so that each card in a 52 card deck is represented in a different square 12.

While, in this embodiment, the indicia used correspond to that displayed on playing cards, it should be understood that indicia from other card-type games could be used, and the game played according to rules for such card-type game.

The suit and value indicia may be randomly generated on each square 12 of each flashboard 10 before each game. Alternatively, different flashboards 10 may be created before play is begun by the players depressing an appropriate button/key or otherwise commanding the player machine to generate randomly different indicia locations on flashboard 10. However created, each flashboard 10 will have its unique (or nearly unique) placement of indicia, thus providing preferably different flashboards 10 for each player and different outcomes for each machine. For example, while square 32 on player one's flashboard might have a Club suit indicia and a Six value indicia, square 32 on player two's flashboard might have a Heart suit indicia and a Queen value indicia. Thus, the calling of ball/number 32 will provide player one with a Six of Clubs and player two with a Queen of Hearts.

Figure 1:
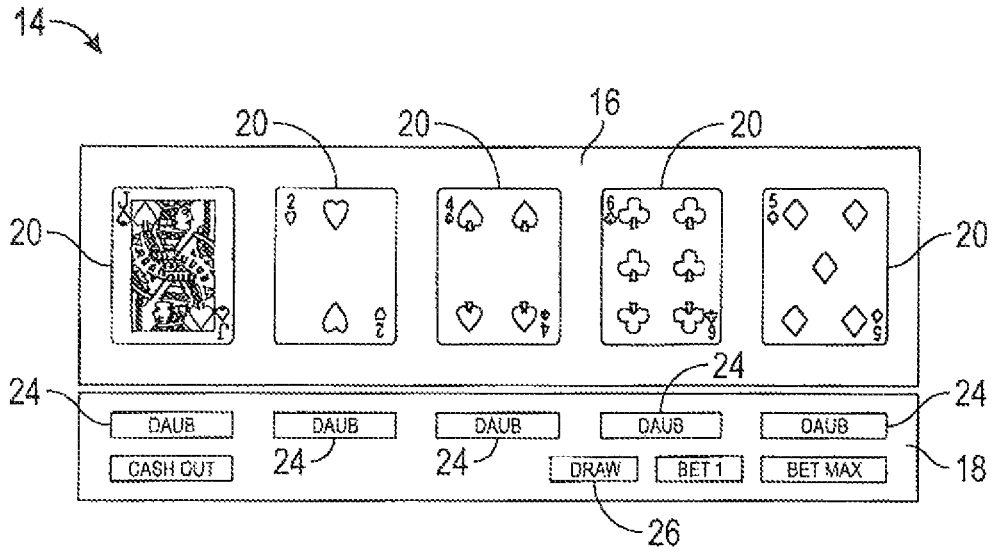
FIG. 1 provides an exemplar of a video terminal, including display screen, of one embodiment of a bingo game of the present invention.
Figure 2:
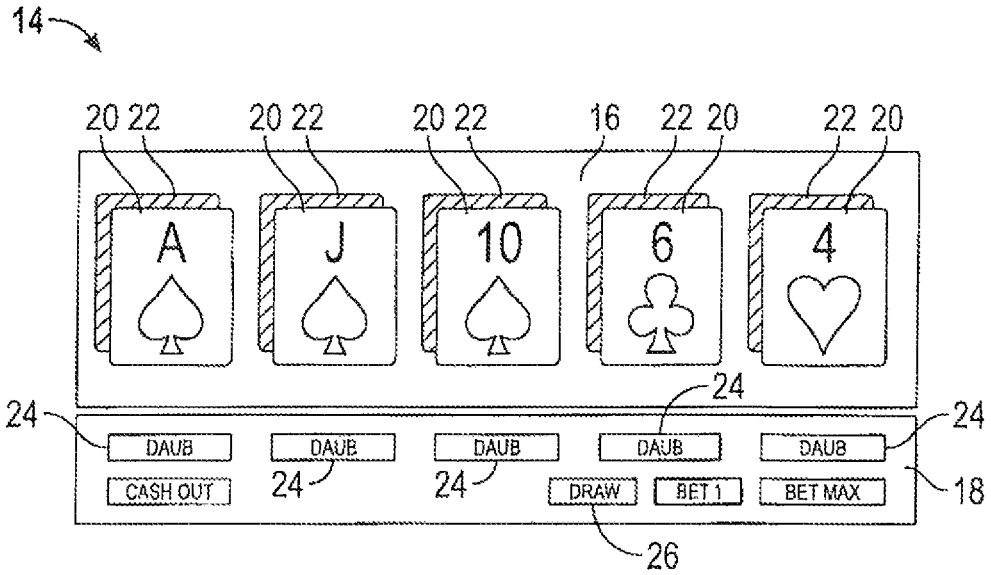
FIG. 2 provides an exemplar of a video terminal, including display screen, of another embodiment of a bingo game of the present invention.

As each ball is drawn and called, the result is electronically communicated to each player machine. (It should be understood that the reference to a ball draw and call is intended to include an electronic draw and an electronic communication of the results of the draw to player machine, and is not meant to be restricted to a manual ball draw or live call by a person.) Referring now to FIG. 1, an exemplar of a player machine 14 is shown. The player machine 14 preferably includes a display screen 16 and a play selection area 18. (It should be understood that the play selection area 18 could be positioned on the player machine 14 separate from the display screen 16 as shown in FIG. 1, or could be displayed on the display screen 16 using touch screen technology or the like.)

Still referring to FIG. 1, the results of the calling of five balls are displayed on the display screen 16, in the form of cards 20 having suit and value indicia corresponding to numbered squares 12 on the flashboard 10. As shown in FIG. 1, the preferred form for displaying the results of the call is in card form, giving the Bingo Poker game the look and feel of a video poker terminal. In the event that the flashboard 10 is also displayed on the display screen 16, it is preferred that upon the calling of each ball, the corresponding square 12 is lit or otherwise modified to indicate that the ball corresponding to that square has been called.

In the preferred embodiment of Poker Bingo, ten balls are called at the beginning of the game. As shown in FIG. 1, only the results for the first five balls will initially be displayed. With respect to the remaining five balls, they are either not initially depicted in any form to the player as shown in FIG. 1, or, referring now to FIGS. 2 and 3, may be represented by an image of a card back 22 or in some other form. (In the event that the flashboard 10 is displayed to the player on the display screen 16, the squares 12 and indicia associated with second group of five balls are not indicated on the flashboard 10 either.)

Each player then electronically daubs those of the first five balls that the player desires to keep by, one card 20 at a time, daubing each card 20 that the player wishes to hold or discard. Daubing is preferably accomplished by the player depressing the daub button 24 for each card to be held—which daub button 24 may be a depressible button or key located in the play selection area 18, a selectable area on a display screen 16 having touch screen capability, or some other vehicle for allowing a player to communicate card selection. (It would also be possible to provide that depression of the daub button 24 would have the effect of highlighting those cards 20 that are to be discarded.)

Once daubing is complete, the player depresses the draw button 26. (It should be noted that the names for the buttons as shown in the drawing figures and as used herein represent examples only, and may be changed as desired.) The undaubed cards 20 are then discarded and replaced with a corresponding number of cards 20 corresponding to balls from the second group of five. If the player daubs (holds) all five cards 20, then no replacement cards are used and the winning hand will be determined using only the original five balls drawn.

There are several possibilities with respect to the manner in which replacement cards 20 are selected from the group corresponding to the second group of five balls. In one embodiment, the machine randomly selects the replacement cards 20 from the second group. In another embodiment, replacement cards 20 are selected from the second group of five balls according to the order in which these balls were called—so that the sixth ball called will be the first replacement, and so on. In yet another embodiment, as depicted for example in FIG. 2, the replacement cards 20 selected will be those corresponding in order to the first five balls selected—so that, for example, the first ball selected will be represented by the first card 20 on the far left side, while the sixth ball selected will be represented by the card back 22 positioned behind the first card 20 on the far left side, and so on.

Figure 3:
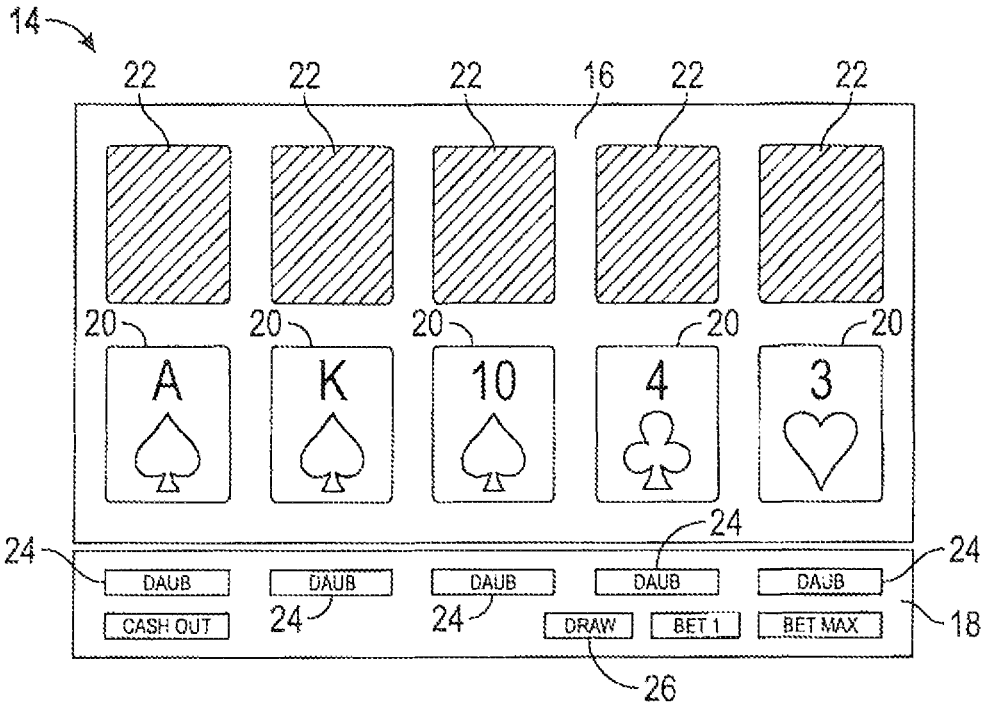
FIG. 3 provides an exemplar of a video terminal, including display screen, of yet another embodiment of a bingo game of the present invention.

In still another embodiment, as depicted for example in FIG. 3, the player can select which replacement cards 20 will be revealed from a row of card backs 22 shown on the display screen. Selection may be accomplished, if touch screen technology is employed, by the player touching the desired card backs 22. Alternatively, the player may depress the daub button 24 associated with the desired card back 22—which, in the configuration shown in FIG. 3, would be the daub button 24 positioned directly below the desired card back 22—revealing each replacement card 20.

It should be noted that the Bingo Poker game and method of the present invention may be adapted to play poker or other card games according to the rules for the particular game. For example, in one variation, only five balls would be drawn, and there would be no replacement balls. Based on the hand produced by the five called balls, the player receives any payout to which he or she is entitled. (Such a game might have the appearance of that shown in FIG. 1.)

This variation is similar to 5 card stud poker, in which a player is paid according to a pay table without any replacement cards being available.

In another variation, seven balls are called and, again, there are no replacement balls. Based on the best hand produced by any five of the seven called balls, the player receives any payout to which he or she is entitled. This variation is similar to 7 card stud poker.

Examples of other poker games that could be played using this method would include triple Play®, bonus poker, Caribbean stud Poker®, holdem poker, and double down Stud®. The present invention could also be utilized to play card games other than poker.

Still other variations are possible to the basic components of the bingo game as discussed above. For example, it would be possible to add a 53rd ball as well as a corresponding 53rd square on the flashboard 10, with the 53rd square representing a wild card or joker. If called, the wild card could be used by the player to represent any suit/value indicia combination that increases the payout to the player.

It would also be possible to provide fewer squares 12 than balls, with an individual square 12 having more than one set of value and suit indicia. If, for example, a particular square 12 had two sets of value and suit indicia, the calling of the ball corresponding to that square 12 would result in an extra card being dealt to the player. The player could either be permitted to keep the extra card or the option of selecting between the two cards corresponding to the square 12, increasing the player's winning prospects. Other variations are also possible.

Another embodiment of the present invention addresses the problem presented by a single ball draw. In this embodiment, overlapping ball draws—possibly though not necessarily from multiple locations—are provided, allowing the playing of overlapping games. For example, if a game takes two minutes to play, a new draw could commence every thirty seconds. Fast player one and slower player two each begin the same game at 1:00 p.m., which game is started by ball draw one. Fast player one, upon finishing the game at 1:00:45 p.m., can participate in a second game, started by a ball draw commencing at 1:01:00 p.m.—even before the first game has closed at 1:02 p.m. Meanwhile, player two can finish his game using all of the allotted time until 1:02 p.m., and participate in a new game commencing at 1:02:00 p.m. or 1:02:30 p.m., etc. Of course, the actual frequency and method of overlapping ball draws can be varied as desired.

One advantage of the multiple ball draw is that the duration of each bingo game can be increased over prior art games, since there is no need to maximize the amount of games that one single ball drawing source can generate. Thus, it can be seen that with multiple ball draws, the needs of slow and fast players can be accommodated. Slow players can play games with longer closing times, so that they can complete their play. On the other hand, fast players can follow one game immediately with another. It should be noted that the multiple ball draw disclosed herein could be incorporated into any bingo-style electronic game—including prior art games currently practiced using a single ball draw—and not only with bingo-style games otherwise described herein.

Bingo rules often require the disclosure to all players at the end of each game how many players were winners in each game and how much they won. This information can be provided in a small square preferably at the bottom of the screen. In one embodiment, the five previous game winners will be disclosed at the bottom of the screen—although more or less than this could be shown. This allows the slower player to take his or her time and to have his or her potential winnings posted before the game is closed.

In another embodiment of the present invention, the rules of bingo can be adopted to provide an electronic game having the look and feel of a video slot machine, and includes on the display a plurality of reels. This game is referred to herein as "Bingo Slots." As with Bingo Poker, in Bingo Slots, each player is provided with at least one flashboard, which flashboard may or may not be displayed on the player's display screen. The flashboard should comprise individual squares having therein at least one indicia—including for example cherries, plums, bells, bars, blanks and other indicia of the type often seen on slot machines—corresponding to the number of bingo balls to be drawn. For example, if there are 90 balls (numbered 1-90), the flashboard should have 90 "squares," numbered 1-90, having indicia therein. (As discussed above, it would be possible to provide a noncorresponding number of flashboard squares and balls.)

Preferably, three balls will be called in a game (i.e., one ball for each reel)—although games with less or more balls may also be played. When the balls are called, the values are communicated to each player machine and the corresponding values on each player flashboard are displayed in any desired format—such as squares or rectangles having images of the indicia therein or thereon. Preferably, the display will have the look and feel of prior art slot machine reels.

Although each player has the same indicia values on his or her flashboard (e.g., 20 cherries, 20 bars, 10 blanks, 10 plums, 30 bells)—each player should have these indicia arranged on the flashboard in a unique or nearly unique manner, so that outcomes among players will be unique or nearly unique. For example, squares 15, 25, and 35 on player one's flashboard might all be cherries, while these squares on player two's flashboard are a cherry, plum, and bar, respectively. There can of course be instances wherein a single machine has multiple type slot games to choose from and individual games can have varying degrees of difficulty. An example of these slot games are "Double Diamond®", "Red, White & Blue®", "Triple Diamond®", "Wheel of Fortune®", "Elvis®", "Betty Boop®" "Slotto®", "Pink Panther®", "Reel 'Em In®", "Monopoly®", "Jackpot Party®", "Addams Family®", "I Dream of Jeannie®" and "Battleship®". The payout will be a function of the difficult of achieving a desired combination, based on the frequency with which a particular value appears on the flashboard.

While it would be possible to provide a single flashboard from which three indicia will be selected as described herein, it would be preferred to provide multiple flashboards per player machine, and preferably one flashboard for each reel in a Bingo Slot game. Thus, if there are three reels, three flashboards are preferably provided. In this manner, the odds of achieving a particular winning combination can be increased exponentially, creating the possibility of relatively large payouts and thus increasing player excitement. Similarly, the number of balls/flashboard squares can be varied as desired to achieve desired game probabilities.

As shown in the following table, the use of multiple flashboards and the variation in the number of balls can substantially alter slot odds:

| Number of Reels | Number of Balls | Slot Odds - One bar per reel |
|---|---|---|
| 1 | 75 | 75 to one |
| 1 | 90 | 90 to one |
| 1 | 105 | 105 to one |
| 2 | 75 | 5,625 to one |
| 2 | 90 | 8,100 to one |
| 2 | 105 | 11,025 to one |
| 3 | 75 | 421,875 to one |
| 3 | 90 | 729,000 to one |
| 3 | 105 | 1,157,625 to one |
| 4 | 75 | 31,640,625 to one |
| 4 | 90 | 65,610,000 to one |
| 4 | 105 | 121,550,625 to one |

Of course, the numbers 75, 90 and 105 are meant to be exemplary only, and the actual number of balls used could be varied as desired.

Figure 5:
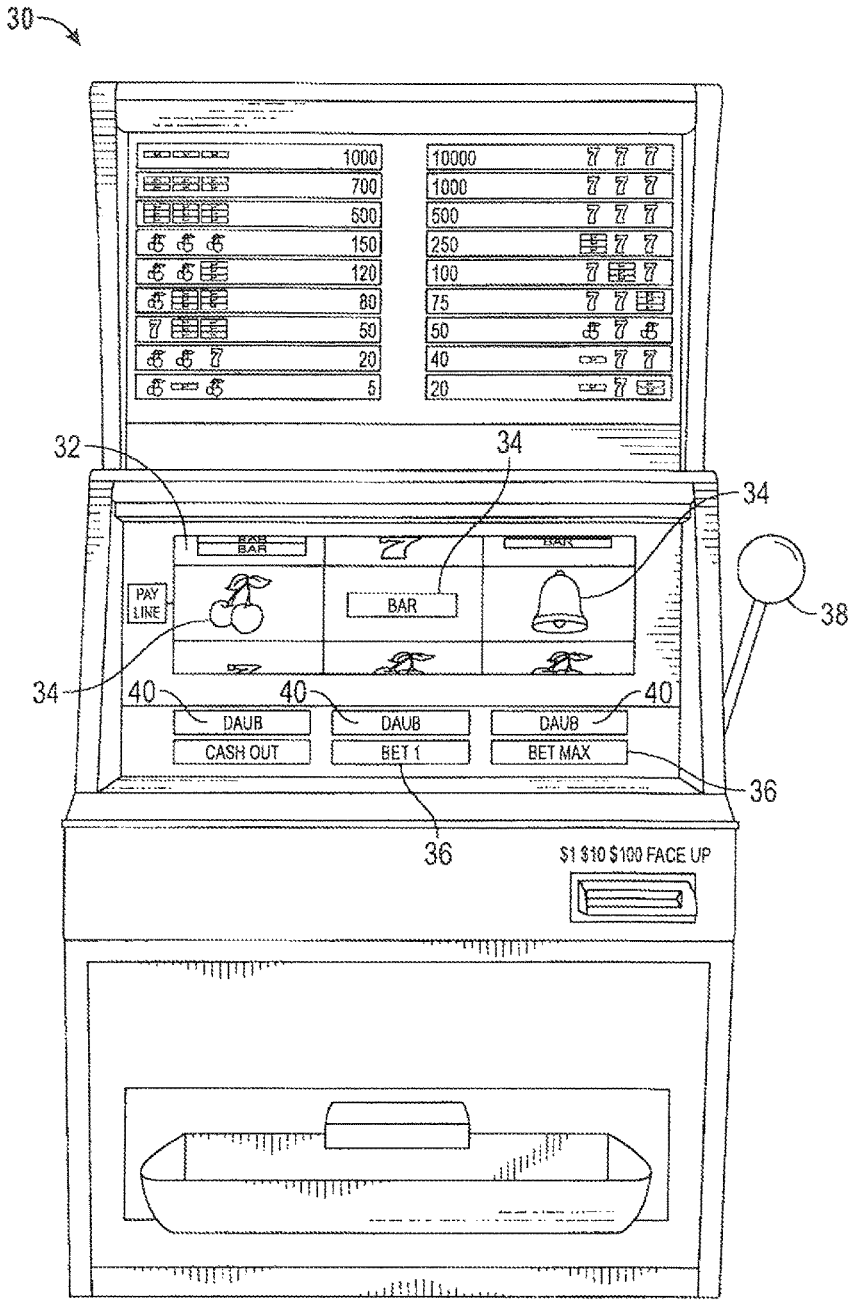
FIG. 5 provides an exemplar of a video terminal, including display screen, of still another embodiment of a bingo game of the present invention.

Referring now to FIG. 5, an exemplar of a video terminal 30 embodying the Bingo Slots variant of the present invention is shown. The video terminal 30 includes a display screen 32, on which is displayed the indicia 34 from the flashboard squares corresponding to the called balls. To use the video terminal 30, a player will place his or her bet using one of the betting keys 36. The player then commences play and accesses the results of the ball draw by pulling the handle 38. The results of the ball draw are then displayed on the display screen 32. To complete play, and consistent with the rules of bingo, the player daubs the indicia 34 appearing on the display screen 32 by depressing the daub keys 40—or by daubing in some other designated manner.

Of course, the features of the video terminal 30 may be altered in any desired fashion. For example, the handle 38 may be replaced with a button, touch screen icon, or other means for commencing play. One daub key 40 could be used in place of individual daub keys 40 for each indicia 34 displayed. It would also be possible to display more than one row of indicia 34 for double, triple, nine-line, etc. play. Still further, it would be possible to substitute a machine having mechanical reels for the video terminal 30 and still be within the scope of the present invention.

Referring now to FIGS. 6-14, another embodiment of the bingo game of the present invention having the look and feel of video poker is shown. For ease of reference, this game will be referred to as "Bingo Poker" herein. The Bingo Poker game is similar to the previous embodiments so differences will be discussed below.

Figure 6:
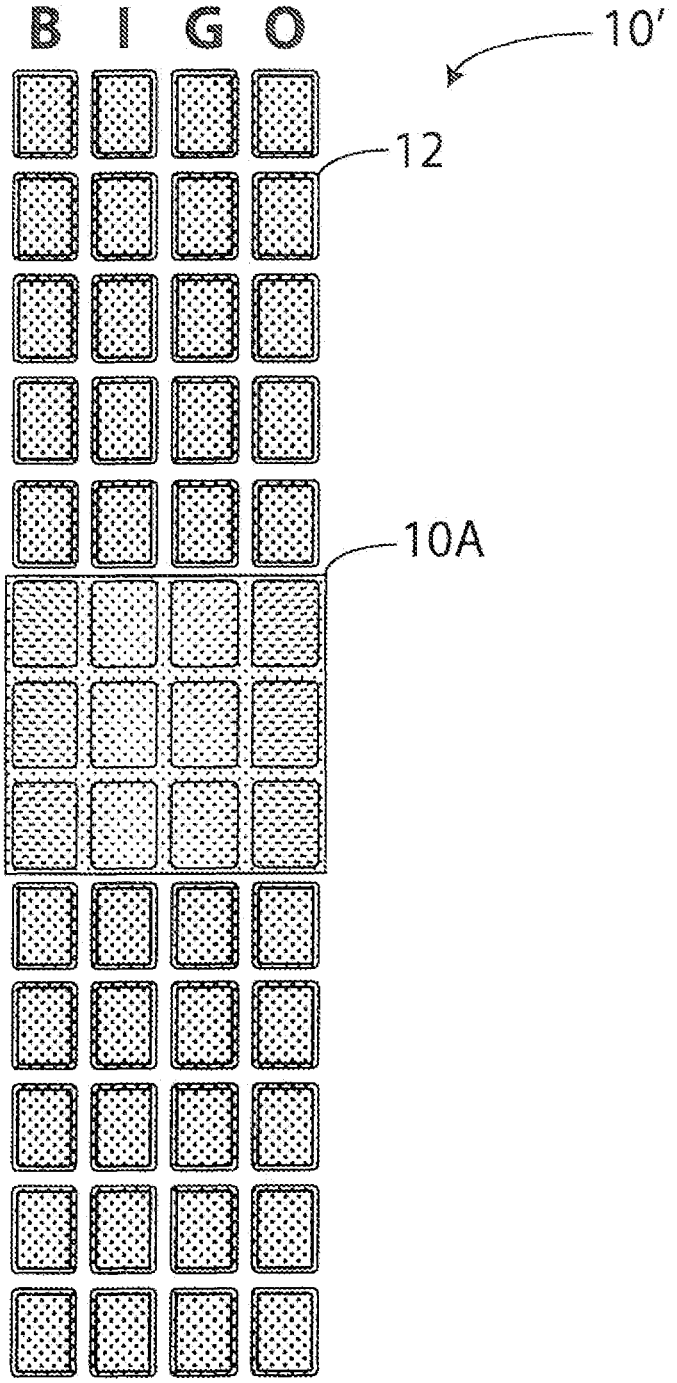
FIG. 6 is a front view of a flashboard used in another embodiment of the bingo poker game of the present invention.

Bingo Poker is a traditional electronic bingo game requiring at least two players to begin where the first player to cover a previously designated bingo pattern (12 spot center box as shown in FIG. 6) on a bingo card 10' wins the game. Draw Poker style bonus prizes may be awarded for creating a winning five card poker hand defined entirely by the spots hit on the player's bingo card 10' within the first ten bingo balls drawn. An additional progressive jackpot bonus prize may be awarded based on a far-miss bingo criterion as will be disclosed below. Like traditional bingo, each player terminal has a unique bingo card and all players in a specific game receive the same ball call.

Figure 14:
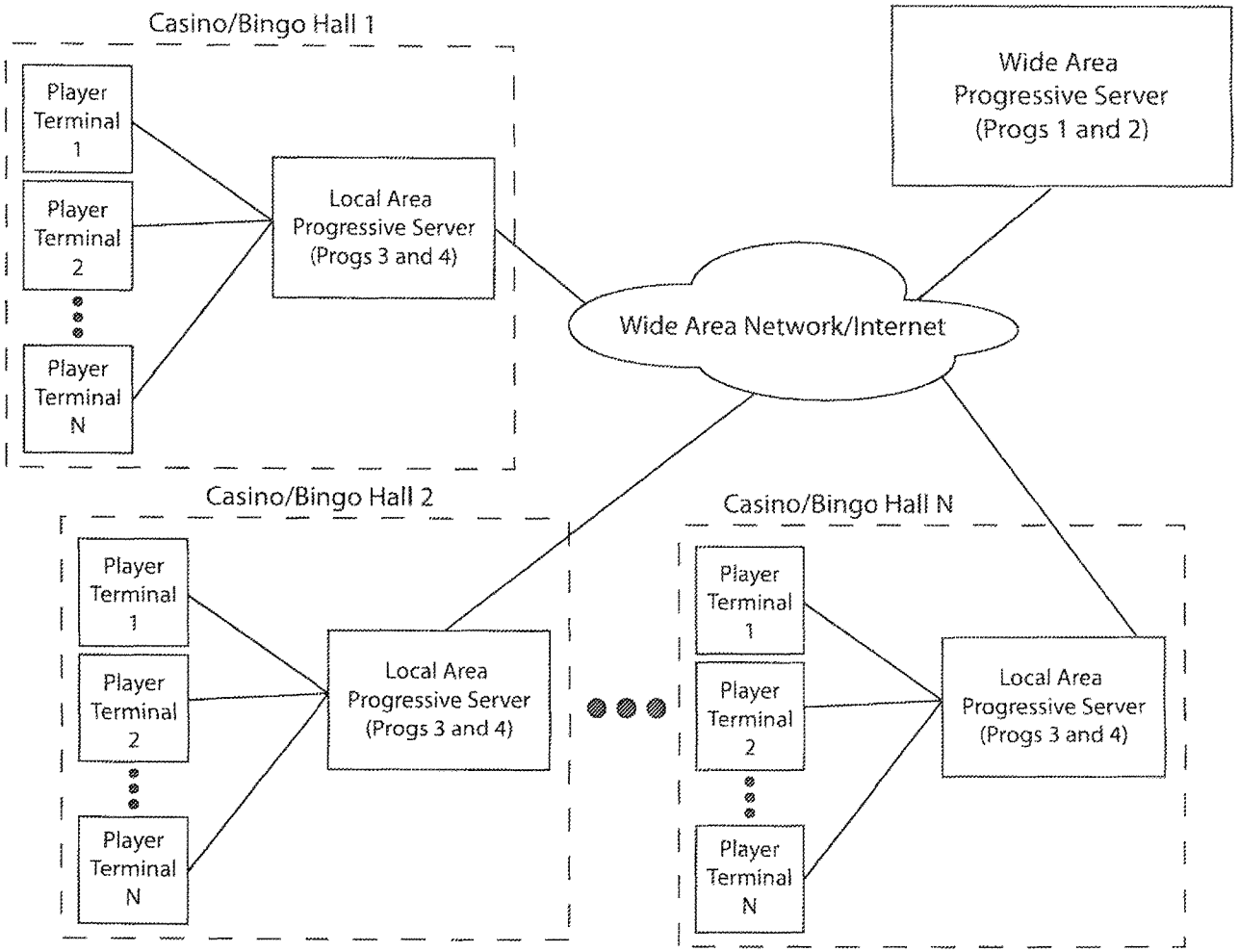
FIG. 14 shows a gaming network for playing the bingo poker game of the present invention.

The game may be facilitated by player terminals providing players with an entertaining interface for interacting with the game, game servers for collecting players into games and delivering game results, and a computer network to facilitate communication between the player terminals and game servers as shown in FIG. 14.

In the present embodiment, Bingo Poker is played similarly to a traditional bingo game where a series of balls are drawn from a 52 ball population and matched by players to bingo cards 10' with the goal of being the first player to achieve a pre-designated game ending bingo pattern 10A (12 spot center box). Other designated game ending bingo patterns may be used without departing from the spirit and scope of the present invention.

Each player has a single, unique 4×13 spot BIGO card 10' with no free space where the numbers 1-13 are placed in random order in the 1$^{st}$ column labeled "B", 14-26 are randomly ordered in the second ("I") column, 27-39 are randomly ordered in the third ("G") column, and 40-52 are randomly ordered in the fourth ("O") column.

In accordance with one embodiment, Bingo Poker may use a unique dual perm system 60 for generating bingo cards 10' for the game. Each player is assigned a 52 spot bingo card at the beginning of the game session that may be used for each game played unless the player chooses to swap cards between games by touching the bingo card 10'. Each 52 spot bingo card is dealt in order from a shuffled card perm of tens of thousands to hundreds of thousands of pre-generated bingo cards selected to minimize the probability of multiple players achieving game ending patterns or progressive jackpot prizes on the same ball, thus resulting in split prizes.

In addition to the persistent bingo card, a second, 52 spot poker card overlay is dealt to each player immediately after a minimum number of players has been established for each game and immediately prior to the first ball being called. Although in some instances the overlay may be generated after the first ball is drawn. This secondary card consists of all 52 playing card faces from a standard deck of 4 suits (hearts, diamonds, spades, and clubs) numbered 2 through 10 and J, Q, K, and A. These overlay cards are dealt in order from a card permutation selected to insure all poker hands have probabilities of being achieved equal to those of a randomly generated draw poker game. For games that require two or more decks, multiple overlay perms could be used with the persistent bingo card, with all perms using the same ball draw. Random number generators may be used in lieu of perms if permitted by gaming regulators.

The bingo poker game consists of a buy in period, an initial ball call (5 balls), a final ball call, and a prize awarding period.

The buy in period remains open until at least 2 players have joined the game 62 or a configurable amount of time expires resulting in no game played and a refund of the purchase. A player joins the game by selecting a buy in amount and pressing the "Deal" button 50. A game will begin as soon as at least two players have purchased bingo cards 10' within the buy in period. Bingo cards 10' cost a minimum of 1 credit and a maximum of 5 credits. Players can be grouped together in games regardless of the price of the card purchased.

Multiple games with overlapping buy in periods may be offered to minimize player wait time between games. Players can be grouped within a single facility or across multiple facilities to efficiently build adequate minimums to start each game.

The initial ball call begins upon the buy in period closing. Five balls are delivered to the player terminal and displayed in the order they were drawn in the ball call display area 52 and displayed on the appropriate squares 12 on the bingo card 10'.

Upon the player pressing the "Draw" button 54, the remaining balls are revealed to the player and displayed in the order they were drawn in the ball call display area 52 and on the appropriate matching squares on the bingo card 10'.

The "Draw" button 54 serves multiple functions including daubing the first 5 balls, revealing and daubing the remaining balls, and claiming any prizes that are won as a result of the game. The number of balls in the final ball call is variable depending on the number of balls required for the first card participating in the current game to achieve the game ending bingo pattern.

Figure 7:
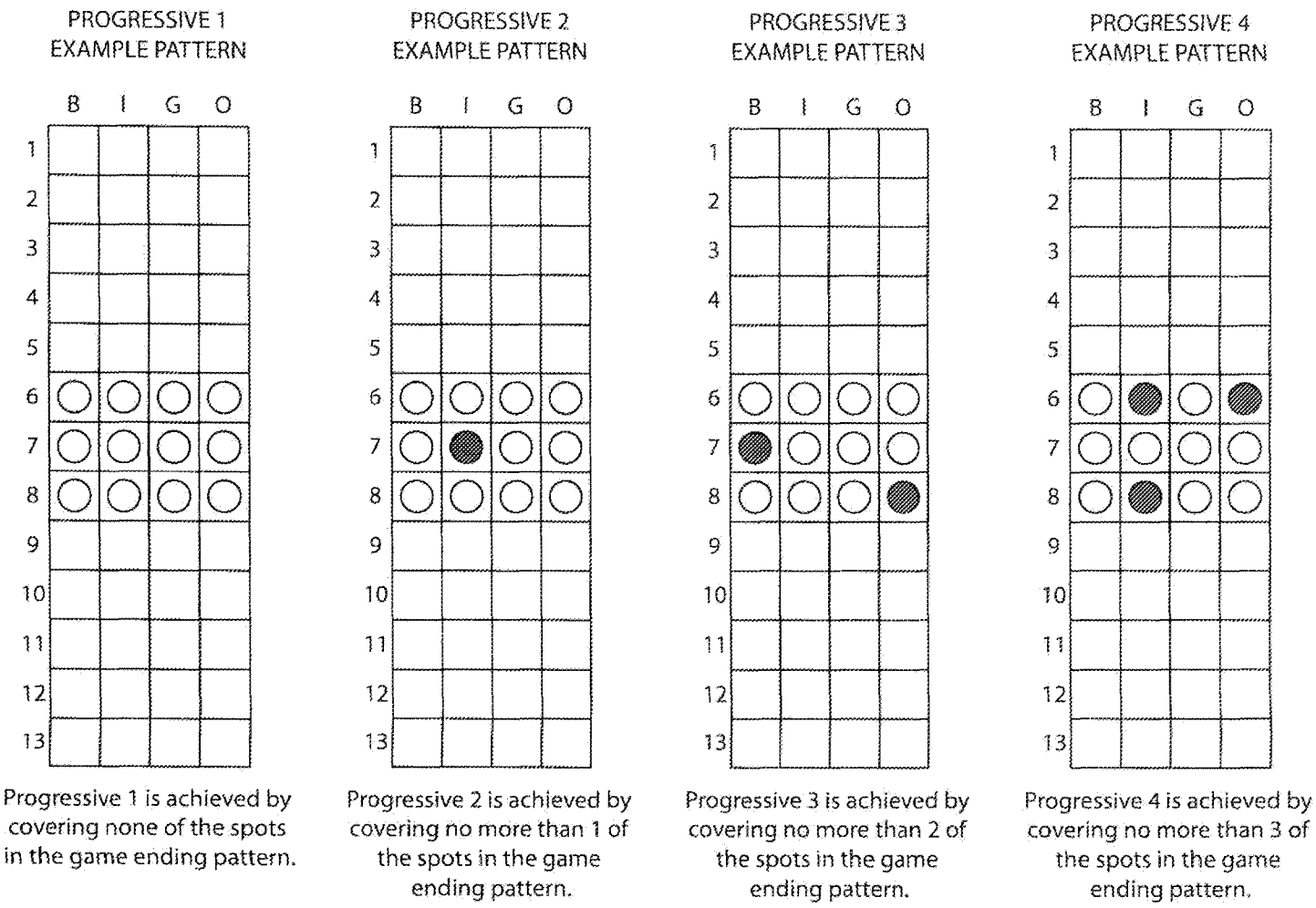
FIG. 7 is a front view of a flashboard showing embodiments of different progressive winning patterns.

Prizes are awarded immediately after the final ball call is displayed for any player that has achieved the game ending bingo pattern and for bonus prizes. In accordance with the present embodiment, there are three types of prizes in Bingo Poker as shown in FIG. 7:

1) Game Ending Bingo Prize—The game ending prize is a minimum of 1 cent or a pre-configured percentage of the players bet (whichever is larger) awarded for the first player to achieve the game ending bingo pattern.
2) Far-miss Bingo Progressives—The far-miss bingo progressives are one or more bonus prizes awarded to player or players with few spots marked in the game ending pattern at the time the game ends due to another player achieving the game ending pattern. If two or more players achieve the jackpot in the same game, all players will split the progressive jackpot prize. The current game design supports up to four far-miss progressives, but only three are being used.
   a. Progressive 1: Mega Jackpot Wide Area Progressive—This progressive is won by the player with no spots covered in the game ending pattern at the time the game ends.
   b. Progressive 2: Super Jackpot Wide Area Progressive—This progressive is won by the player with only 1 spot covered in the game ending pattern at the time the game ends.
   c. Progressives 3 and 4: Local Area Jackpots (optional)—One or both of these progressives can be activated by the local operator by configuring a win criteria based on the number of spots away from achieving a game ending bingo, similar to progressives 1 and 2. The current game design leverage progressive 3 as a far-miss, local area progressive won by having only 2 hits in the game ending pattern at the time the game ends.
3) Poker Bonus Prizes—The poker bonus prizes are determined based on the poker hand achieved by the player during the course of the bingo game according to the poker paytable discussed below and shown in FIG. 8. It would also be possible to require the players to make a separate wager to qualify for the progressive jackpot(s).

The draw poker game is a secondary bonusing mechanism based entirely on the spots marked on each player's bingo card 10', but uniquely incorporating the player's skill at making a winning poker hand for determining bonus prizes.

After the buy in period has closed and prior to the first ball being delivered to the player terminal, a secondary bingo card consisting of 52 playing card faces from a separate card perm is delivered to each player and displayed face down (only card backs 56 showing) on top of the player's traditional bingo card. This secondary bingo card creates a unique bingo card to playing card mapping for each player.

Immediately following the delivery of the secondary poker overlay card and the initial ball draw, the playing card corresponding to the spot marked on the bingo card for each of the first 5 balls drawn is displayed in order on the player's game screen 58. This grouping of 5 cards is equivalent to the "deal" hand in a draw poker game.

The player touches between 0 and 5 cards to be kept for the final poker hand. After selecting the cards to be kept (or no cards to be kept), the player presses the "Deal/Daub" 50 button to swap any cards that were not daubed and to reveal any prizes won by the poker game. Cards are swapped in order based on the $6^{th}$-$10^{th}$ balls called beginning with card face corresponding to the $6^{th}$ ball replacing the first card swapped (not kept) and continuing through the playing cards corresponding with the $7^{th}$, $8^{th}$, $9^{th}$, and $10^{th}$ balls drawn as required to replace the remaining swapped cards.

Figures 8, 9:
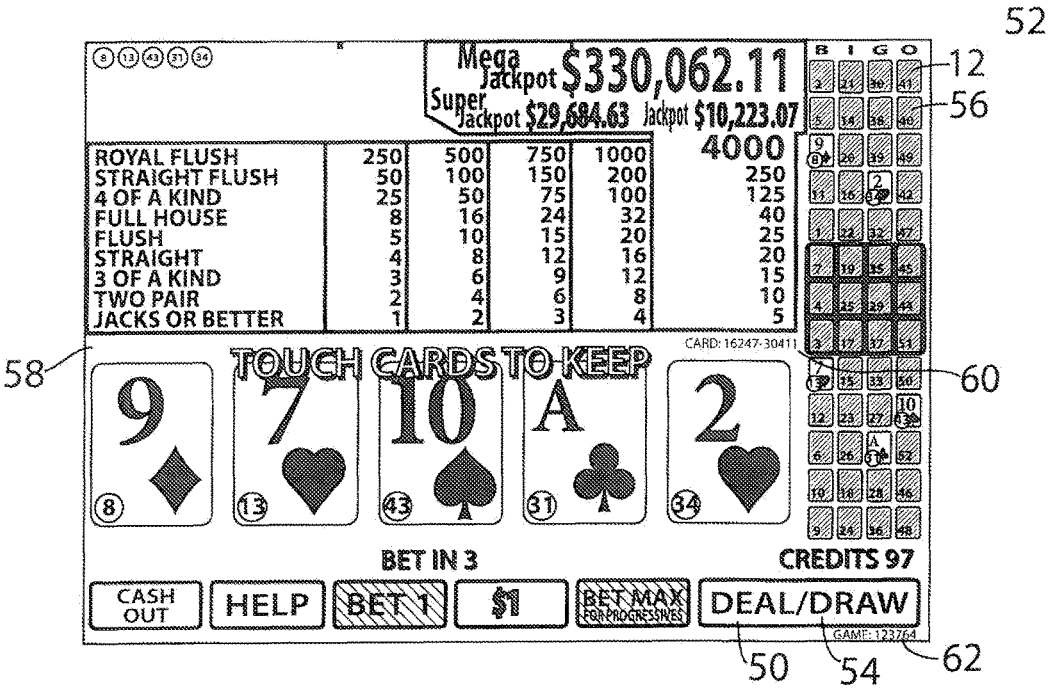
FIG. 8 shows a front view of a sample draw poker paytable for the bingo poker game of the present invention.
FIG. 9 shows a front view of an initial ball call state for the bingo poker game of the present invention.
Figure 10:
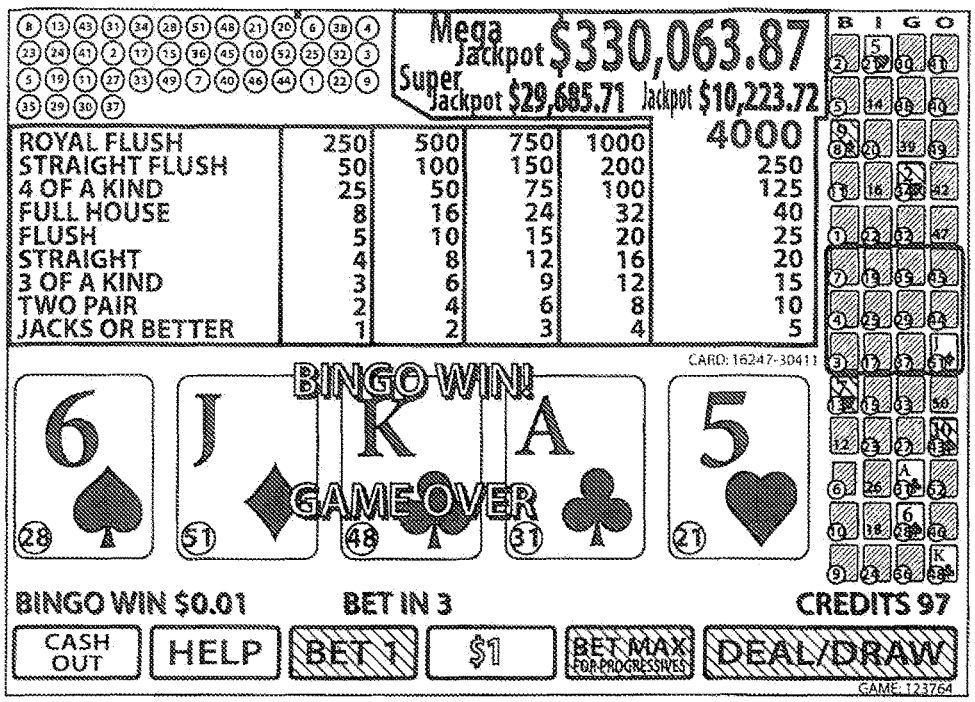
FIG. 10 shows a front view of a game over state-bingo win for the bingo poker game of the present invention.
Figure 11:
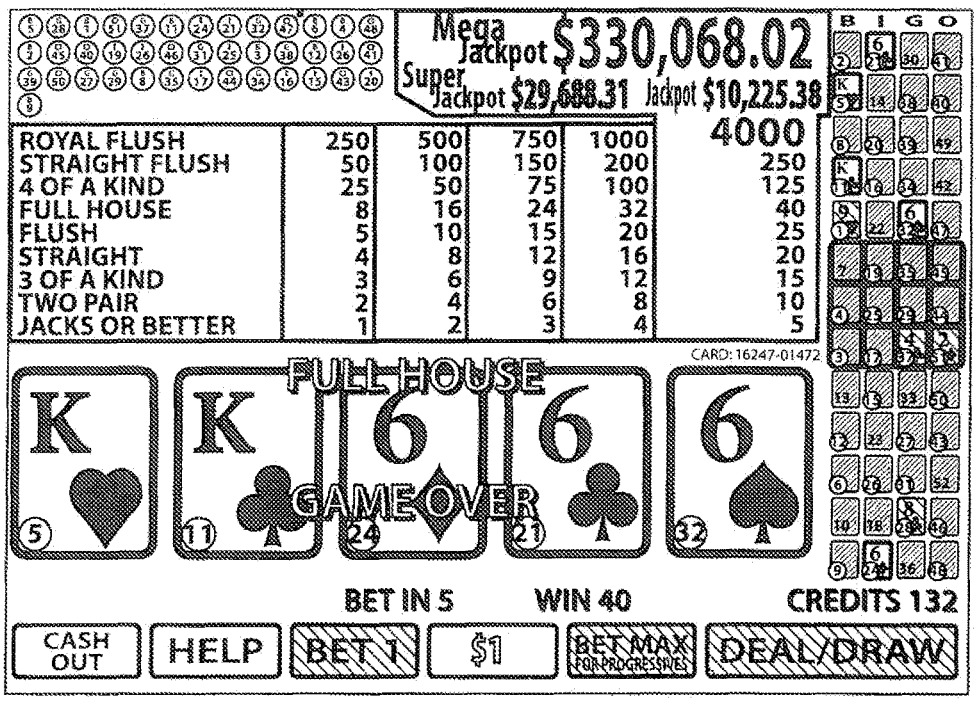
FIG. 11 shows a front view of a game over state-poker win for the bingo poker game of the present invention.
Figure 12:
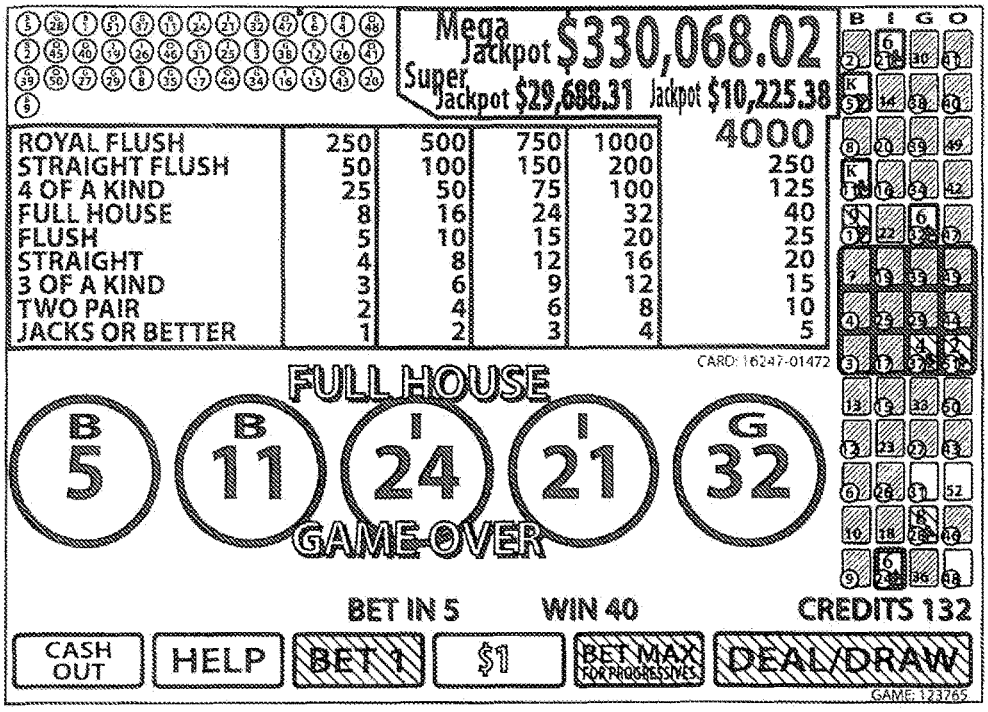
FIG. 12 shows a front view of game over state-poker win (No Card Display) for the bingo poker game of the present invention.
Figure 13:
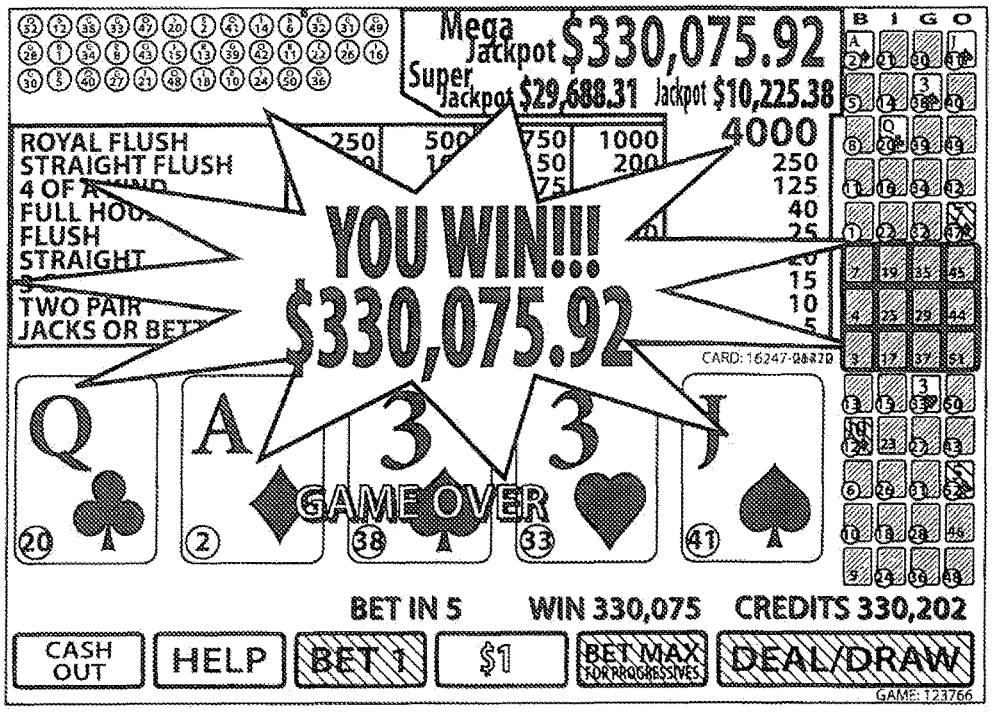
FIG. 13 shows a front view of a game over state-progressive win for the bingo poker game of the present invention.

Prizes are awarded at the conclusion of the bingo game based on the poker hand created by each player according to the poker paytable. An example of a typical draw poker paytable is shown in FIG. 8.

Referring now to FIGS. 15-25*a*, another embodiment of the bingo game of the present invention is shown. For ease of reference, the game will be reference as Spot the Daub. Spot the Daub is a variation on the above Bingo Poker disclosed above. However, Spot the Daub allows a player to play multiple bingo cards simultaneously where the symbol match is based on selections made on the first of the multiple bingo cards. In the embodiment disclosed below, Spot the Daub will be described as using three bingo cards. However, this is shown as an example and should not be seen in a limiting manner.

Figure 15:
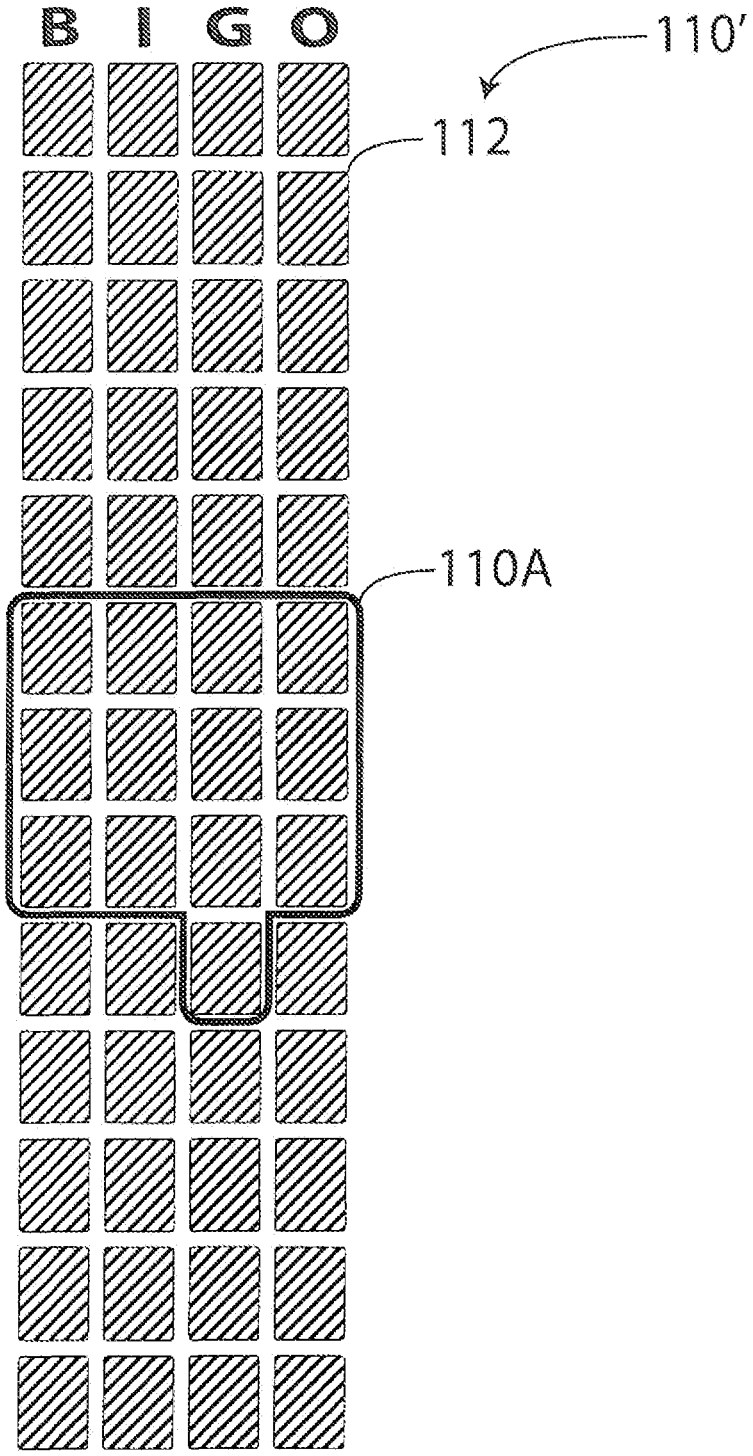
FIG. 15 is a front view of a flashboard having a highlighted game ending pattern used in an embodiment of the bingo poker game of the present invention.

Referring now to FIG. 15, one embodiment of the flashboard/bingo card 110' (hereinafter flashboard 100') is shown. The flashboard 110' generally has a plurality of spots 112. In the present embodiment, a 4×13 array of spots 112 is formed having 4 rows and 13 columns. There are no free spaces. Numbers 1-13 are placed in random order in the 1st column labeled "B". Numbers 14-26 are randomly ordered in the second ("I") column. Numbers 27-39 are randomly ordered in the third ("G") column. Numbers 40-52 are randomly ordered in the fourth ("O") column. Since the numbers are randomly ordered in each column, on each card, most all flashboards 110' are unique as to their overall configuration. The above embodiment is not meant to be a limitation on the types of bingo cards; it is merely descriptive of one of the preferred embodiments.

Each flashboard 110' may further have a card overlay in each spot 112. The card overlay may be represented by a card from a standard deck of 52 playing cards. Thus, the card overlays may consist of 13 Symbols in each of four suits, i.e., hearts, clubs, diamonds, and spades. The 13 symbols in each suit are ranked sequentially in descending order, according to common playing card values—with Ace being the highest and the Deuce being lowest symbol values. The Ace can also be used as low in certain circumstances. The Card Overlays are randomly generated and grouped in a series and may be subdivided into smaller series/sets. Alternatively, in other versions of the game, other symbol designations could be utilized, such as slot machine fruit symbols, cartoon symbols, Hawaiian Island Symbols or pictures of famous personalities. These indicia are randomly distributed across the 52 square overlay card face, overlaying one indicia to each spot 112. The overlay card consists of 52 squares, organized into four columns and 13 rows.

All flashboards 110' may have a designated pattern 110A. The designated pattern 110A may be of different configurations. In the present embodiment, the designated pattern 110A may be a block of 12 plus 1 pattern as shown in FIG. 15.

Referring now to FIGS. 15-25*a*, description of the game will be described. The game initially has a buy in period. The buy in period generally remains open until at least 2 players have joined the game or a configurable amount of time expires resulting in no game played and a refund of the purchase. A player joins the game by selecting a buy in amount and pressing the "Daub/Draw" button 150/154. A game will begin as soon as at least two players have purchased 1 or more flashboards 110' within the buy in period, with each flash board 110' representing a bingo card. In accordance with one embodiment, each player may purchase 1 to 3 flashboards 110'. Each flashboard 110' generally costs a minimum of 1 credit and a maximum of 5 credits for a total possible purchase of 15 credits per game per player (3 cards at 5 credits each). Players can be grouped together in games regardless of the quantity or price of cards purchased.

As with the previous embodiments, multiple games with overlapping buy in periods may be offered to minimize player wait time between games. Players can be grouped within a single facility or across multiple facilities to efficiently build adequate minimums to start each game.

Once a game has begun, a screen 158 may display the player's flashboard 110' at a flashboard display area 155. Each flashboard 110' may show the designated number generated at each spot 112. A card backing 156 may also be show relating to the card overlay at each spot 112. The screen 158 may further have a switch 174 to switch between and show which card is being displayed, a designated card serial number displayed in area 160 of the screen 158, and a game number display shown in area 162 of the screen 158.

An initial ball call begins upon the buy in period closing. Initially, five balls are generally delivered to the player terminal and displayed in the order they were drawn in a top area 166 of the ball call display area 152. The initial ball call may also be displayed on the appropriate squares on the player's flashboard 110'.

Upon the player pressing the "Daub/Draw" button 150/154, a second group of balls are revealed to the player and displayed in the order they were drawn in the ball call display area 152 and on the appropriate matching squares of each flashboard 110'. The "Daub/Draw" button 150/154 serves multiple functions including daubing the first 5 balls, revealing and daubing the remaining balls, and claiming any prizes that are won as a result of the game. In this embodiment the final ball call consists of a minimum of 8 additional balls, but the actual number of balls called is variable depending on the number of balls required for the first card participating in the current game to achieve the game ending bingo pattern. Thus, in the present example, the initial ball call was 5 balls, and the final ball call is 8 balls totaling 13 balls the minimum needed to form the game ending pattern 110A. It should be noted in the Symbol Match game with poker cards, no cards/balls are discarded. They are swapped (replaced) in order based on the 6th-10th balls called and continue to be used in the game ending pattern prize and the progressive jackpot prizes.

Prizes may be awarded immediately after the final ball call is displayed for any card that has achieved the game ending bingo pattern and for bonus prizes. In general, there are three types of prizes in Spot the Daub:

1) Game Ending Bingo Prize—The game ending prize is a minimum of 1 cent or a pre-configured percentage of the players bet (whichever is larger) awarded for the first player to achieve the game ending bingo pattern 110A (Block of 12 plus 1).
2) Far-miss Bingo Progressives—The far-miss bingo progressives are one or more interim bonus prizes awarded to a player or players with few spots marked in the game ending pattern at the time the game ends due to a card in play achieving the game ending pattern. If two or more players achieve the same progressive jackpot prize in the same game, each card meeting the progressive criteria will receive an equal share of the progressive jackpot achieved. The current game design supports up to four far-miss progressives.
   a. Progressive 1: Mega Jackpot Wide Area Progressive—This progressive is won by the player with no spots 192' covered in the game ending pattern at the time the game ends.
   b. Progressive 2: Super Jackpot Wide Area Progressive—This progressive is won by the player with only 1 spot covered in the game ending pattern at the time the game ends.
   c. Progressives 3 and 4: Local Area Jackpots (optional)—One or both of these progressives can be activated by the local operator by configuring a win criteria based on the number of spots away from achieving a game ending bingo, similar to progressives 1 and 2. The current game design includes progressives 3 and 4 as far-miss, local area progressives won by having only 2 or 3 hits respectively in the game ending pattern at the time the game ends.
3) Poker Bonus Prizes—The poker bonus prizes are determined based on the poker hand achieved by the player during the course of the bingo game according to the poker paytable discussed below.

The draw poker game is a secondary interim prize bonusing mechanism based entirely on the spots marked on each of the flashboards 110' in play by each player, but uniquely incorporating the player's skill at making a winning poker hand for determining bonus prizes.

As disclosed above, each flashboard 110' may further have a card overlay in each spot 112. The card overlay may be represented by a card from a standard deck of 52 playing cards. Each flashboard 110' may show the designated number generated at each spot 112. A card backing 156 may also be show relating to the card overlay at each spot 112.

Figure 16:
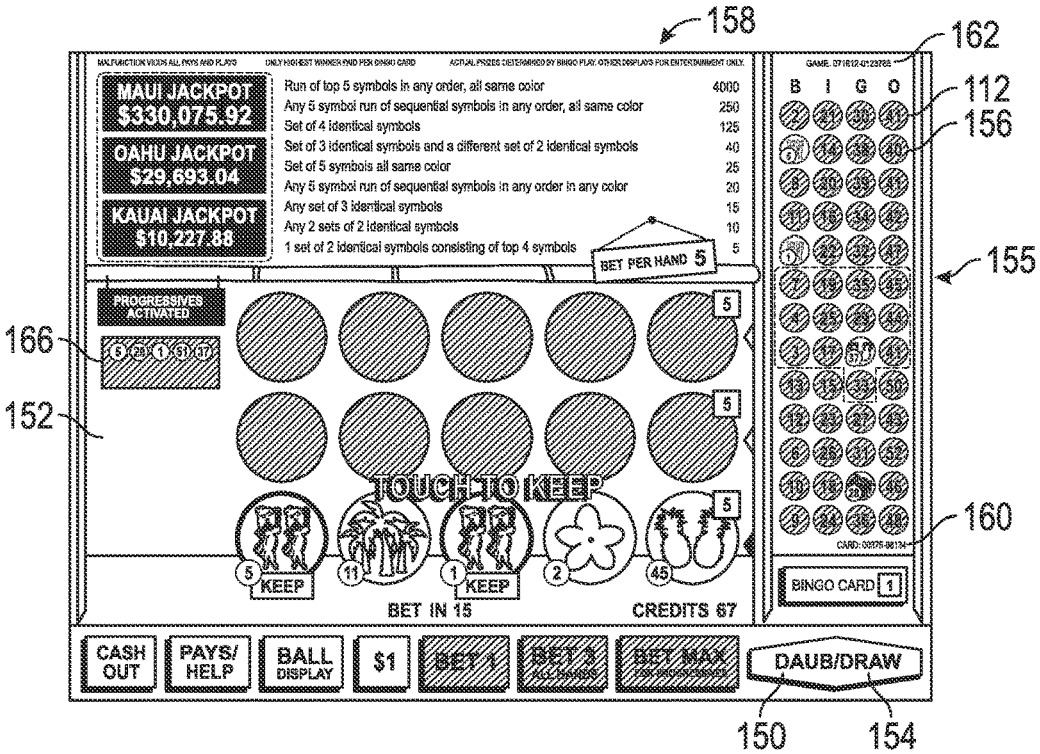
FIG. 16 shows a front view of an initial ball call state for the bingo poker game of the present invention with player's keep/swap sections.
Figure 16A:
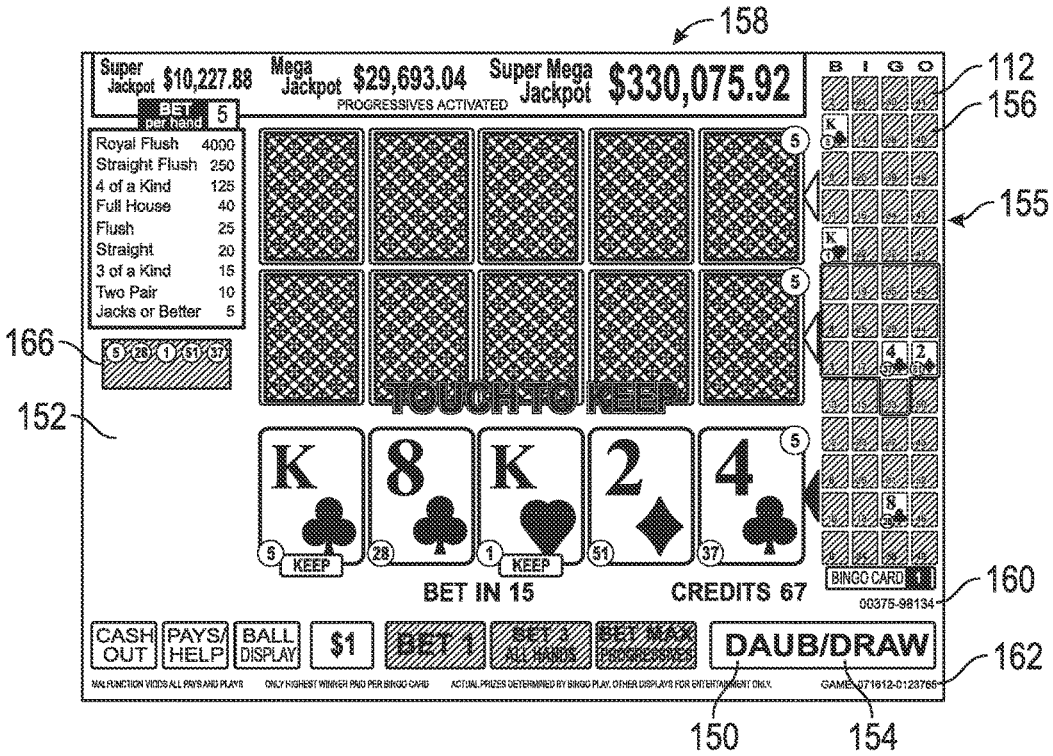
FIG. 16*a* shows another front view of an initial ball call state for the bingo poker game of the present invention with player's keep/swap sections.
Figure 17:
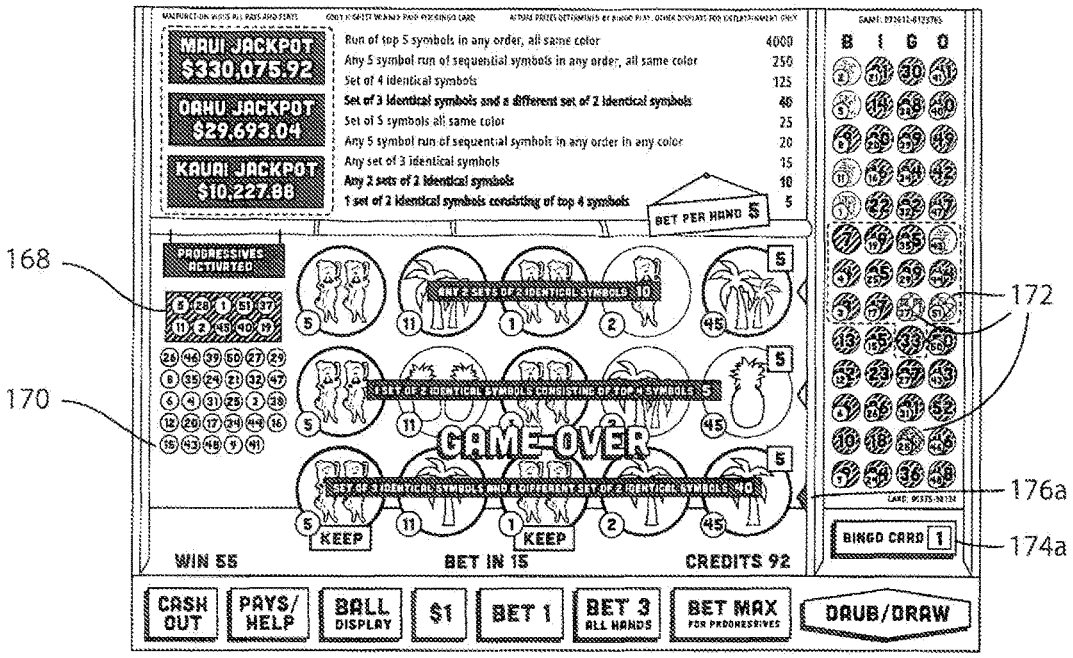
FIG. 17 shows a front view of a final game state depicting winning bonus poker hands of a first bingo card.
Figure 17A:
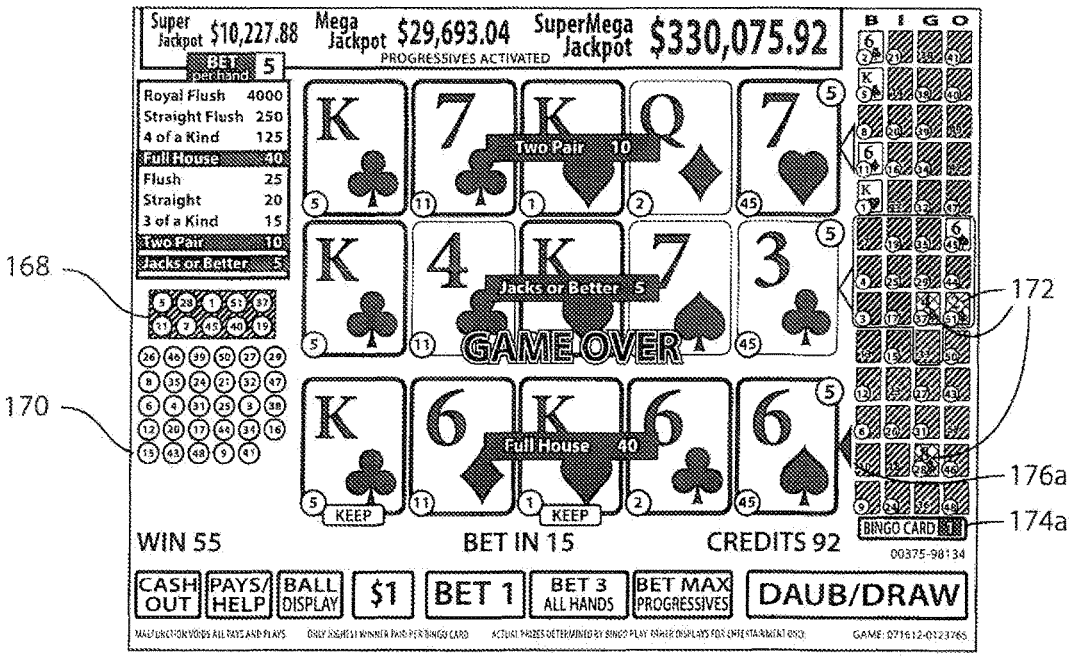
FIG. 17*a* shows another embodiment of a front view of a final game state depicting winning bonus poker hands of a first bingo card.
Figure 18:
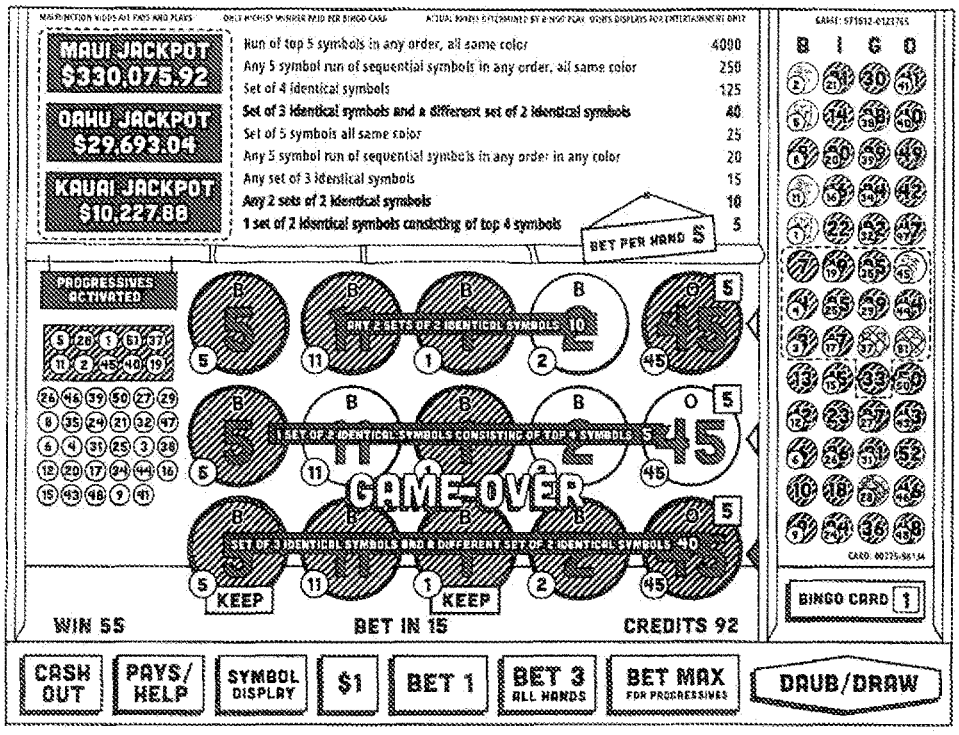
FIG. 18 shows a front view of a winning game screen of FIG. 17 with alternate "ball only" display.
Figure 18A:
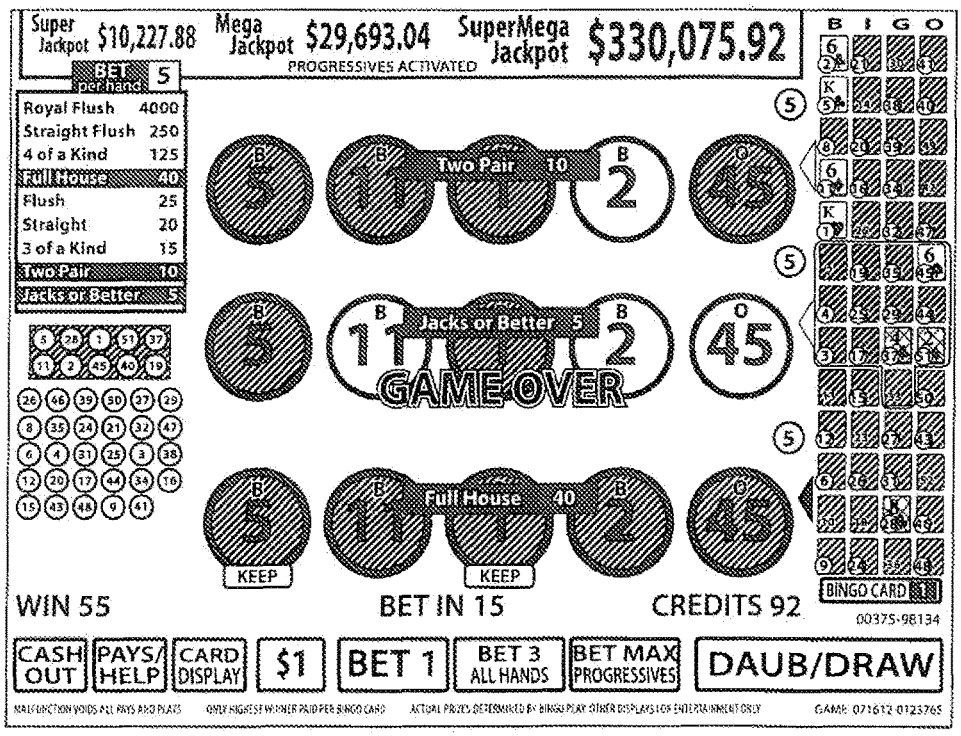
FIG. 18*a* shows a front view of a winning game screen of FIG. 17*a* with alternate "ball only" display.
Figure 22:
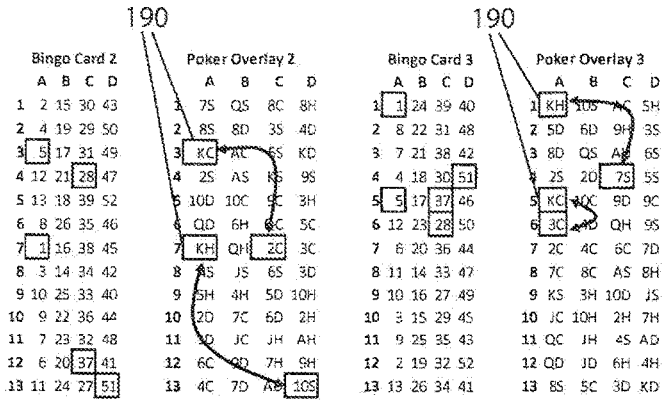
FIG. 22 overlay cards 2 and 3 after swap to correct poker indicia mismatch.
Figure 23:
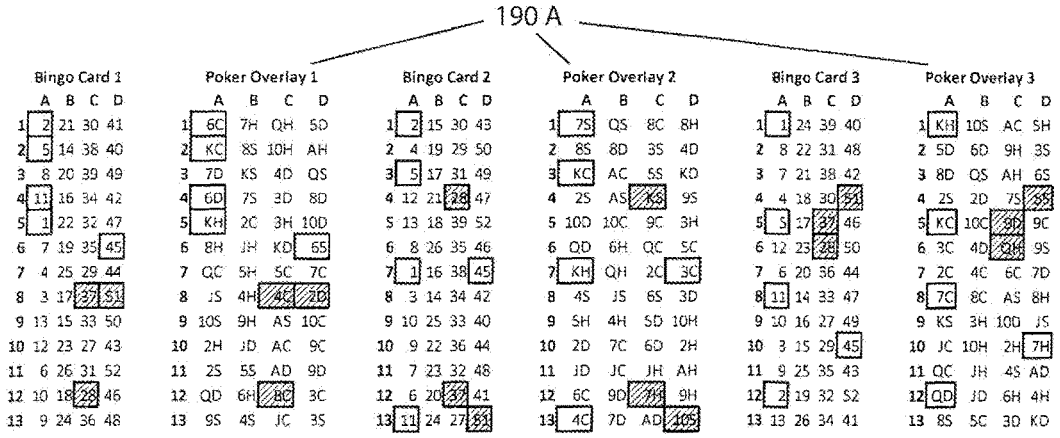
FIG. 23 shows the final bingo and overlay cards depicting 8 balls and associated poker indicia used in determination of poker bonus prizes and correspond to FIG. 17, clear numbers and indicia are used in the final bonus payout poker hands, all bingo hits, whether shaded or not, are used in game ending pattern and determination of progressive prizes.
Figure 24:
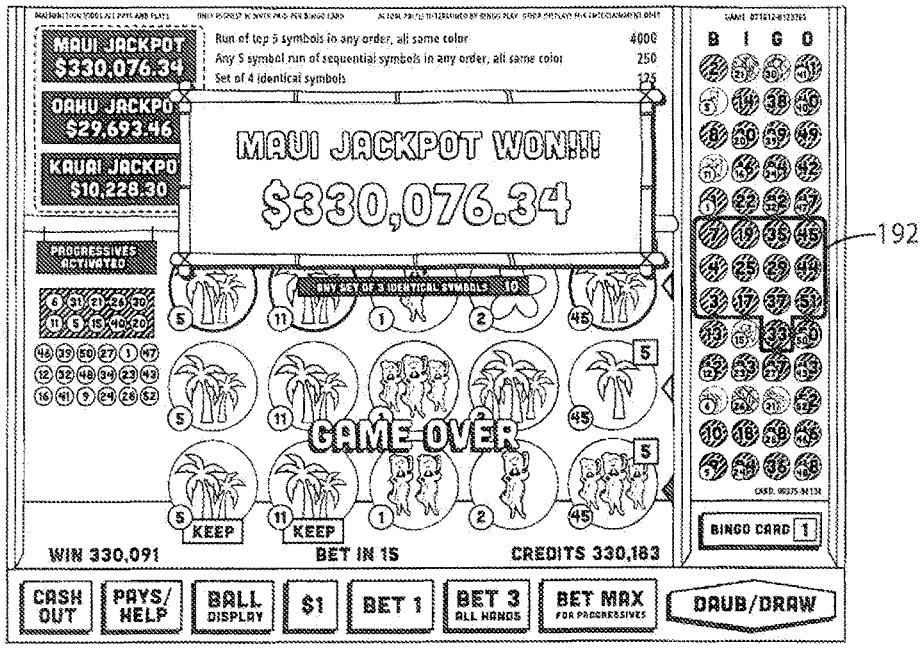
FIG. 24 shows a game screen depicting progressive win for Spot the Daub game.
Figure 24A:
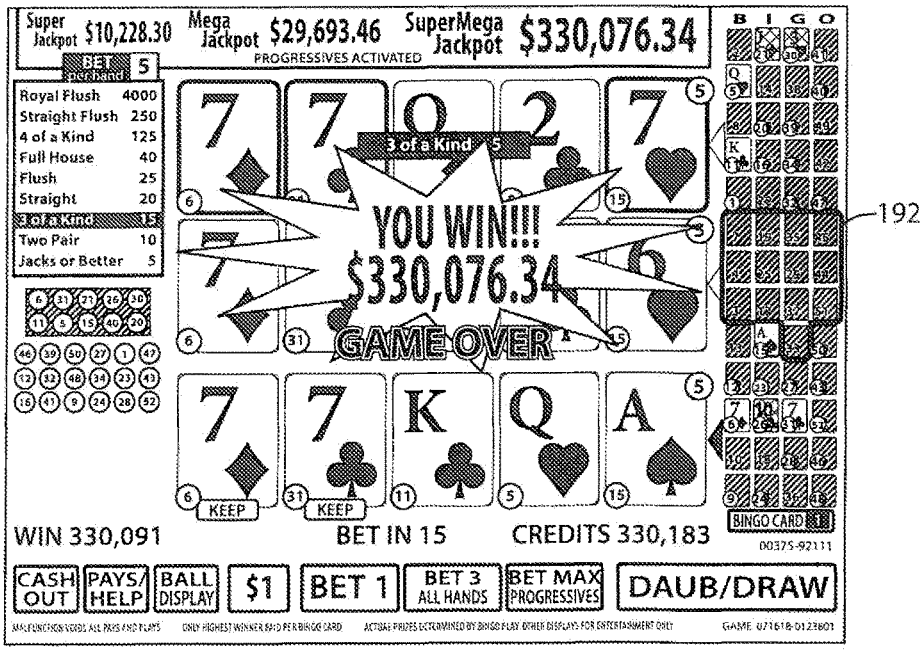
FIG. 24*a* shows another embodiment of a game screen depicting progressive win for Spot the Daub game.

Immediately following the delivery of the secondary poker overlay card and the initial ball draw, the playing card corresponding to the spot marked on the first bingo card for each of the first 5 balls drawn is displayed in order on the player's game screen 158 as draw poker hand one (See FIGS. 16-16*a*). This grouping of 5 cards is equivalent to the "deal" hand in a draw poker game.

The player may touch between 0 and 5 balls/cards to be kept for the final poker hand. Upon selecting the balls/cards to be kept (or no cards to be kept), the draw poker hands corresponds to a flashboard 110', 2 and 3 (if the player is playing more than one flashboard 110') are populated with the kept poker cards in the same positions as in the "dealt" hand corresponding to the first bingo card. The player presses the "Daub/Draw" button to replace any balls/cards that were not kept in all three hands based on the unique mapping between each bingo card and its corresponding draw poker overlay card and to reveal any prizes achieved by the final draw poker combination for cards 1, 2, and 3 (See FIGS. 17-17.2*a*). Cards are replaced in order based on the 6th-10th balls called beginning with card face corresponding to the 6th ball replacing the first card swapped (not held) and continuing through the playing cards corresponding with the 7th, 8th, 9th, and 10th balls drawn as required to replace the remaining swapped cards.

Prizes are awarded at the conclusion of the bingo game based on each of the poker hands created by each player according to the poker paytable. Examples of the paytable may be seen in FIGS. 25-25*a*.

Spot the Daub uses a unique dual perm system for generating flashboards 110' for the game. Each player is assigned up to three 52 spot flashboards 110' at the beginning of the gaming session that will be used for each game played unless the player chooses to exchange cards between games by touching the flashboard 110'. Each 52 spot bingo card is dealt in order from a shuffled card perm of tens of thousands to hundreds of thousands of pre-generated flashboards 110' selected to minimize the probability of multiple players achieving game ending patterns or progressive jackpot prizes on the same ball, thus resulting in split prizes. Each player receives one poker hand per bingo card in play. The use of overlay card perms is not meant to be limiting as random number generators could be used to generate poker indicia if permitted by regulators.

Each player may further have a second 52 spot poker overlay card for each flashboard 110' in play (1 to 3) immediately after a suitable number of players has been established for each game and immediately prior to the first ball call being called. This secondary card consists of all 52 unique symbols from a standard deck of 4 suits (hearts, diamonds, spades, and clubs) numbered 2 through 10 and J, Q, K, and A. These poker overlay cards are also dealt in order from a card permutation that has been generated and randomly distributed by a Random Number Generator.

Like the previous embodiment disclosed above, single hand Bingo Symbol Match, the first of these poker overlay cards is fixed throughout the game and provides a unique mapping of bingo card spots to poker symbols. Unlike single hand Bingo Symbol Match, the poker overlay to bingo card mapping for cards 2 and 3 may change for anywhere from 0 to all 5 of the initial balls drawn based on the player's keep/swap decisions on the first hand.

Switching the poker symbol locations on these poker overlays is best illustrated with the following example. The game begins with three bingo cards and three associated poker overlays as shown in FIG. 19. Each bingo card has a 1 to 1 mapping of columns and rows. In our example, the first five balls drawn bear the numbers 5, 28, 1, 51, and 37 mapping to an initial Poker Symbol hand of KC, 8C, KH, 2D, and 4C (See FIG. 16*a*). The player elects to keep the KC and KH, spots 180 on the flashboard 110' (FIGS. 16 and 20) followed by pressing the Daub/Draw button 150/154.

Pressing the Daub/Draw button 150/154 releases the remaining balls (at least 8) and populates hands 2 and 3 with bingo balls 5 and 1 (spots 180) since the player elected to keep these two based on the poker hand displayed.

Since the balls drawn do not map correctly to the KC and KH on $2^{nd}$ and $3^{rd}$ flashboards 110', these symbols are switched from their original positions on the poker overlay card to the positions corresponding to the 1st and 3rd balls called, numbers 5 and 1. This provides the bingo to poker mapping needed to allow the keep/swap decisions based on the $1^{st}$ flashboard 110' to also drive the $2^{nd}$ and $3^{rd}$ flashboards 110' (See FIG. 21). The result of the switch is a matching of the bingo number spot to a poker symbol overlay mapping for kept poker cards for poker hands 2 and 3 (See FIGS. 22 and 23).

While the invention has been particularly shown and described with reference to preferred embodiments thereof, it will be understood by those skilled in the art that the foregoing and other changes in form and details may be made therein without departing from the spirit and scope of the invention.

What is claimed is:

1. A video gaming system comprising:

a game server; and a plurality of player machines connected to the game server by a gaming network, wherein each player machine comprises a housing, a video screen supported by the housing, a play selection area, and a plurality of input devices supported by the housing, the plurality of input devices including a touch screen, a switch, a cash out button, a pays/help button, a ball display button, a plurality of wager buttons, and one of a deal/draw button and a daub/draw button, and wherein each player machine is configured to:

display on the video screen of the player machine of the video game system a combination bingo and poker video game;

receive from the game server a plurality of individual electronic bingo cards for each player, wherein each electronic bingo card comprises fifty-two spaces that are configured into four columns and thirteen rows, each space defined by a column label and a space number, wherein the space number is randomly selected from a predefined number range for each column, wherein numbers 1-13 are randomly assigned to the spaces in a first column, numbers 14-26 are randomly assigned to the spaces in a second column, numbers 27-39 are randomly assigned to the spaces in a third column, numbers 40-52 are randomly assigned to the spaces in a fourth column, wherein the individual electronic bingo card having a game ending pattern outlined thereon, and wherein each designated number for each of the fifty-two spaces on the individual electronic bingo card is revealed;

receive from the game server a plurality of secondary fifty-two spot poker overlay cards, wherein each overlay card comprises fifty-two spots that are configured into four columns and thirteen rows, wherein each overlay card has indicia on each spot that is on top of each space on a corresponding electronic bingo card, wherein indicia is provided for each space on the corresponding electronic bingo card via the indicia on each spot of the overlay card, wherein the indicia comprises each of suit and value indicia so that each card in a fifty-two card deck of playing cards is represented in a different space of the electronic bingo card, wherein each indicia provided for each of the fifty-two spaces on the individual electronic bingo card is hidden, and wherein a first poker overlay card is fixed throughout the game and provides a unique mapping of bingo card spaces to poker indicia;

receive from the game server a plurality of electronic bingo balls for common use for all players, wherein each bingo ball has a number and wherein each number corresponds to one of the plurality of spaces on each electronic bingo card, a total number of bingo balls corresponding to a total number of the plurality of spaces on each individual electronic bingo card;

receive selection input from each player of a buy in amount for the game;

receive, via a pressing of the one of a deal/draw button and a daub/draw button, an input from each player to join the game;

receive from the game server a first group of ten electronic bingo balls for common use for all players, wherein the first group of ten electronic bingo balls are randomly selected via electronic draw;

receive from the game server the results of the draw of the first group of ten electronic bingo balls;

initially display on the video screen to each player the numbers associated with each of only a first five of the first group of ten selected electronic bingo balls;

receive from the game server each numbered space associated with each of the first five of the first group of ten selected electronic bingo balls on each individual electronic bingo card;

display on the video screen the indicia associated with each said numbered space corresponding to each of the first five of the first group of ten selected electronic bingo balls on a first electronic bingo card, wherein said indicia form a first poker hand, wherein only the first poker hand is revealed and any other poker hand remains hidden, and wherein the indicia provided for each of the remaining spaces on the first electronic bingo card remains hidden;

receive, via a touching of the touch screen, selection input from each player on the play selection area desired indicia to be kept by each player, wherein the player makes selection input only on the first poker hand;

receive, via a pressing of the switch, an input from at least one player to switch between the plurality of individual electronic bingo cards for the at least one player to show which bingo card is being displayed to the at least one player;

receive, via a pressing of the one of a deal/draw button and a daub/draw button, a final input from each player, wherein the final input causes a simultaneous occurrence of:

the selected indicia to be kept by each player forming indicia for a plurality of poker hands being played simultaneously by each player, the number of poker hands equal to the number of individual electronic bingo cards and corresponding poker overlay cards being played by the player, wherein the location of poker indicia on a plurality of non-first poker overlay cards changes during the game for up to and including five of the initial balls drawn based on a player's selection input of desired indicia to be kept on the first poker hand;

receiving from the game server a second group of electronic bingo balls for common use for all players, wherein the second group of electronic bingo balls are randomly selected via electronic draw and wherein a total number of bingo balls in the first group of ten electronic bingo balls and the second group of electronic bingo balls is equal to a least amount of balls needed to completely fill the game ending pattern;

receiving from the game server the results of the draw of the second group of electronic bingo balls;

displaying on the video screen to each player the numbers associated with each of a second five of the first group of ten selected electronic bingo balls and each selected bingo ball of the second group of electronic bingo balls;

displaying on the video screen any winning electronic bingo card;

displaying on the video screen the indicia associated with each of the numbered spaces corresponding to each of the second five of the first group of ten selected electronic bingo balls and each selected bingo ball of the second group of electronic bingo balls;

receiving from the game server indicia associated with a numbered space corresponding to a selected bingo ball of the second five of the first group of ten selected electronic bingo balls, wherein the indicia associated with the numbered space corresponding to the selected bingo ball of the second five of the first group of ten selected electronic bingo balls has been electronically and automatically swapped for the non-selected indicia of the first poker hand and remaining portions of the additional poker hands, and wherein the selected desired indicia kept by the user has been electronically and automatically switched for indicia on the non-first individual electronic bingo cards by electronically and automatically switching locations of the desired indicia kept by the player from an initial location on each non-first individual electronic bingo card to a location indicated by a numbered space on a first individual electronic bingo card corresponding to the desired indicia selected; and displaying on the video screen all poker hands and any winning player indicia combinations, wherein the server of the video gaming system is capable of conducting multiple games simultaneously, each game having its own independent electronic ball draw.

2. The video gaming system of claim 1, wherein determining any winning electronic bingo card further comprises determining if any electronic bingo card of any player has completely filled the game winning pattern with the least amount of balls needed to completely fill the game ending pattern being drawn.

3. The video gaming system of claim 1, wherein determining any winning electronic bingo card further comprises determining if any electronic bingo card of any player has achieved a far-miss bingo progressive, wherein the far miss bingo progressive comprises at least one of no spots covered in the game ending pattern at the time the game ends; only one spot covered in the game ending pattern at the time the game ends.

4. The video gaming system of claim 1, wherein electronically swapping non-selected indicia with indicia associated with a numbered space corresponding to a selected bingo ball of the second five of the first group of ten selected electronic bingo balls further comprises electronically swapping non-selected indicia with indicia associated with the numbered space corresponding to the selected bingo ball of the second five of the first group of ten selected electronic bingo balls using a first selected bingo ball of the second five of the first group of ten selected electronic bingo balls first and going in ascending order.

5. The video gaming system of claim 1, wherein electronically swapping non-selected indicia with indicia associated with each said numbered space corresponding to each selected bingo ball of the second five of the first group of ten selected electronic bingo balls further comprises:

electronically swapping a first non-selected indicia with indicia associated with a first numbered space corresponding to a first selected bingo ball of the second five of the first group of ten selected electronic bingo balls;

electronically swapping a second non-selected indicia with indicia associated with a second numbered space corresponding to a second selected bingo ball of the second five of the first group of ten selected electronic bingo balls;

electronically swapping a third non-selected indicia with indicia associated with a third numbered space corresponding to a third selected bingo ball of the second five of the first group of ten selected electronic bingo balls;

electronically swapping a fourth non-selected indicia with indicia associated with a fourth numbered space corresponding to a fourth selected bingo ball of the second five of the first group of ten selected electronic bingo balls; and electronically swapping a fifth non-selected indicia with indicia associated with a fifth numbered space corresponding to a fifth selected bingo ball of the second five of the first group of ten selected electronic bingo balls.

6. The video gaming system of claim 1, wherein the plurality of individual electronic bingo cards comprises three electronic bingo cards, and wherein the plurality of poker hands comprises three poker hands.

7. The video gaming system of claim 1, wherein each electronic bingo card is generated by a random number generator.

8. The video gaming system of claim 1, wherein the program instructions further comprise beginning each game of the multiple games automatically when at least two players have each purchased at least one bingo card within a buy in period.

9. The video gaming system of claim 1, wherein each game comprises at least two players and wherein the at least two players are grouped within one of a single gaming facility and across multiple gaming facilities.

10. The video gaming system of claim 1, wherein the indicia on the secondary poker card overlay is generated by a random number generator.

11. A video gaming system comprising:

a game server; and a plurality of player machines connected to the game server by a gaming network, wherein each player machine comprises a housing, a video screen supported by the housing, a play selection area, and a plurality of input devices supported by the housing, the plurality of input devices including a touch screen, a switch, a cash out button, a pays/help button, a ball display button, a plurality of wager buttons, and one of a deal/draw button and a daub/draw button, and wherein each player machine is configured to:

display on the video screen of the player machine of the video game system a combination bingo and poker video game;

receive from the game server a plurality of individual electronic bingo cards for each player, wherein each electronic bingo card comprises fifty-two spaces that are configured into four columns and thirteen rows, each space defined by a column label and a space number, wherein the space number is randomly selected from a predefined number range for each column, wherein numbers 1-13 are randomly assigned to the spaces in a first column, numbers 14-26 are randomly assigned to the spaces in a second column, numbers 27-39 are randomly assigned to the spaces in a third column, numbers 40-52 are randomly assigned to the spaces in a fourth column, wherein the individual electronic bingo card having a game ending pattern outlined thereon, and wherein each designated number for each of the fifty-two spaces on the individual electronic bingo card is revealed;

receive from the game server a plurality of secondary fifty-two spot poker overlay cards, wherein each overlay card comprises fifty-two spots that are configured into four columns and thirteen rows, wherein each overlay card has indicia on each spot that is on top of each space on a corresponding electronic bingo card, wherein indicia is provided for each space on the corresponding electronic bingo card via the indicia on each spot of the overlay card, wherein the indicia comprises each of suit and value indicia so that each card in a fifty-two card deck of playing cards is represented in a different space of the electronic bingo card, wherein each indicia provided for each of the fifty-two spaces on the individual electronic bingo card is hidden, and wherein a first poker overlay card is fixed throughout the game and provides a unique mapping of bingo card spaces to poker indicia;

receive from the game server a plurality of electronic bingo balls for common use for all players, wherein each bingo ball has a number and wherein each number corresponds to one of the plurality of spaces on each electronic bingo card, a total number of bingo balls corresponding to a total number of the plurality of spaces on each individual electronic bingo card;

receive selection input from each player of a buy in amount for the game;

receive, via a pressing of the one of a deal/draw button and a daub/draw button, an input from each player to join the game;

receive from the game server a first group of ten electronic bingo balls for common use for all players, wherein the first group of ten electronic bingo balls are randomly selected via electronic draw;

receive from the game server the results of the draw of the first group of ten electronic bingo balls;

initially display on the video screen to each player the numbers associated with each of only a first five of the first group of ten selected electronic bingo balls;

receive from the game server each numbered space associated with each of the first five of the first group of ten selected electronic bingo balls on each of the plurality of individual electronic bingo cards;

display on the video screen the indicia associated with each numbered space corresponding to each of the first five of the first group of ten selected bingo balls on a first electronic bingo card, wherein said indicia form a first poker hand, wherein only the first poker hand is revealed and any other poker hand remains hidden, and wherein the indicia provided for each of the remaining spaces on the first electronic bingo card remains hidden;

receive, via a touching of the touch screen, selection input from each player on the play selection area desired indicia to be kept by each player, the desired indicia selected forming portions of additional poker hands being played simultaneously by each player, the number of poker hands equal to the number of individual electronic bingo cards and corresponding poker overlay cards being played by the player, wherein the player makes selection input only on the first poker hand, wherein the location of poker indicia on a plurality of non-first poker overlay cards changes during the game for up to and including five of the initial balls drawn based on a player's selection input of desired indicia to be kept on the first poker hand;

receive, via a pressing of the switch, an input from at least one player to switch between the plurality of individual electronic bingo cards for the at least one player to show which bingo card is being displayed to the at least one player;

receive, via a pressing of the one of a deal/draw button and a daub/draw button, a final input from each player, wherein the final input causes a simultaneous occurrence of:

receiving from the game server a second group of electronic bingo balls for common use for all players, wherein the second group of electronic bingo balls are randomly selected via electronic draw and wherein a total number of bingo balls in the first group of ten electronic bingo balls and the second group of electronic bingo balls is equal to a least amount of balls needed to completely fill the game ending pattern;

receiving from the game server the results of the draw of the second group of electronic bingo balls;

displaying on the video screen to each player the numbers associated with each of a second five of the first group of ten selected electronic bingo balls and each selected bingo ball of the second group of electronic bingo balls;

displaying on the video screen any winning electronic bingo cards;

displaying on the video screen the indicia associated with each said numbered space corresponding to each of the second five of the first group of ten selected electronic bingo balls and each selected bingo ball of the second group of electronic bingo balls;

receiving from the game server indicia associated with a numbered space corresponding to a selected bingo ball of the second five of the first group of ten selected electronic bingo balls, wherein the indicia associated with the numbered space corresponding to the selected bingo ball of the second five of the first group of ten selected electronic bingo balls has been electronically and automatically swapped for the non-selected indicia of the first poker hand and remaining portions of the additional poker hands by electronically and automatically swapping non-selected indicia with indicia associated with the numbered space corresponding to the selected bingo ball of the second five of the first group of ten selected electronic bingo balls using a first selected bingo ball of the second five of the first group of ten selected electronic bingo balls first and going in ascending order, and wherein the selected desired indicia kept by the player has been electronically and automatically switched for indicia on the non-first individual electronic bingo cards by electronically and automatically switching locations of the desired indicia kept by the player from an initial location on each non-first individual electronic bingo card to a location indicated by a numbered space on a first individual electronic bingo card corresponding to the desired indicia selected; and displaying on the video screen all poker hands and any winning player indicia combination, wherein the server of the video gaming system is capable of conducting multiple games simultaneously, each game having its own independent electronic ball draw.

12. The video gaming system of claim 11, wherein determining any winning electronic bingo cards further comprises determining if any electronic bingo card of any player has completely filled the game winning pattern with the least amount of balls needed to completely fill the game ending pattern being drawn.

13. The video gaming system of claim 12, wherein determining any winning electronic bingo cards further comprises determining if any electronic bingo card of any player has achieved a far-miss bingo progressive, wherein the far miss bingo progressive comprises at least one of no spots covered in the game ending pattern at the time the game ends; only one spot covered in the game ending pattern at the time the game ends.

14. The video gaming system of claim 11, wherein the plurality of individual electronic bingo cards comprises three electronic bingo cards, and wherein the additional poker hands comprises a second poker hand and a third poker hand.

15. The video gaming system of claim 11, wherein each electronic bingo card is generated by a random number generator.

16. The video gaming system of claim 11, wherein the program instructions further comprise beginning each game of the multiple games automatically when at least two players have each purchased at least one bingo card within a buy in period.

17. The video gaming system of claim 11, wherein each game comprises at least two players and wherein the at least two players are grouped within one of a single gaming facility and across multiple gaming facilities.

18. The video gaming system of claim 11, wherein the indicia on the secondary poker card overlay is generated by a random number generator.

19. A video gaming system comprising:

a game server; and a plurality of player machines connected to the game server by a gaming network, wherein each player machine comprises a housing, a video screen supported by the housing, a play selection area, and a plurality of input devices supported by the housing, the plurality of input devices including a touch screen, a switch, a cash out button, a pays/help button, a ball display button, a plurality of wager buttons, and one of a deal/draw button and a daub/draw button, and wherein each player machine is configured to:

display on the video screen of the player machine of the video game system a combination bingo and poker game;

receive from the game server a plurality of individual electronic bingo cards for each player, wherein each electronic bingo card comprises fifty-two spaces that are configured into four columns and thirteen rows, wherein the individual electronic bingo card having a game ending pattern outlined thereon;

receive from the game server a plurality of secondary fifty-two spot poker overlay cards, wherein each overlay card comprises fifty-two spots that are configured into four columns and thirteen rows, wherein each overlay card has indicia on each spot that is on top of each space on a corresponding electronic bingo card, wherein indicia is provided for each space on the corresponding electronic bingo card via the indicia on each spot of the overlay card, wherein the indicia comprises each of suit and value indicia so that each card in a fifty-two card deck of playing cards is represented in a different space of the electronic bingo card, and wherein each indicia provided for each of the fifty-two spaces on the individual electronic bingo card is hidden, and wherein a first poker overlay card is fixed throughout the game and provides a unique mapping of bingo card spaces to poker indicia;

receive from the game server a plurality of electronic bingo balls for common use for all players, wherein each bingo ball has a marking and wherein each marking corresponds to one of the plurality of spaces on each electronic bingo card, a total number of bingo balls corresponding to a total number of the plurality of spaces on each individual electronic bingo card;

receive selection input from each player of a buy in amount for the game;

receive, via a pressing of the one of a deal/draw button and a daub/draw button, an input from each player to join the game;

receive from the game server a first group of ten bingo balls for common use for all players, wherein the first group of ten bingo balls are randomly selected via electronic draw;

receive from the game server the results of the draw of the first group of ten electronic bingo balls;

initially display on the video screen to each player the markings associated with each of only a first five of the first group of ten selected electronic bingo balls;

receive from the game server electronic markings of each space associated with each of the first five of the first group of ten selected electronic bingo balls on each individual electronic bingo card;

display on the video screen the indicia associated with each said space corresponding to each of the first five of the first group of ten selected bingo balls on a first electronic bingo card, wherein said indicia form a first poker hand, wherein only the first poker hand is revealed and any other poker hand remains hidden, and wherein the indicia provided for each of the remaining spaces on the first electronic bingo card remains hidden;

receive, via a touching of the touch screen, selection input from each player on the play selection area desired indicia to be kept by each player, wherein the player makes selection input only on the first poker hand;

wherein the selected indicia to be kept by each player forms indicia for a plurality of poker hands being played simultaneously by each player, the number of poker hands equal to the number of individual electronic bingo cards and corresponding poker overlay cards being played by the player, wherein the location of poker indicia on a plurality of non-first poker overlay cards changes during the game for up to and including five of the initial balls drawn based on a player's selection input of desired indicia to be kept on the first poker hand;

receive, via a pressing of the switch, an input from at least one player to switch between the plurality of individual electronic bingo cards for the at least one player to show which bingo card is being displayed to the at least one player;

receive, via a pressing of the one of a deal/draw button and a daub/draw button, a final input from each player, wherein the final input causes a simultaneous occurrence of:

receiving from the game server a second group of electronic bingo balls for common use for all players, wherein the second group of electronic bingo balls are randomly selected via electronic draw and wherein a total number of bingo balls in the first group of ten electronic bingo balls and the second group of electronic bingo balls is equal to a least amount of balls needed to completely fill the game ending pattern;

receiving from the game server the results of the draw of the second group of electronic bingo balls;

displaying on the video screen to each player the markings associated with each of a second five of the first group of ten selected electronic bingo balls and each selected bingo ball of the second group of electronic bingo balls;

displaying on the video screen any winning electronic bingo card;

displaying on the video screen any electronic bingo card of any player that has completely filled the game winning pattern with the least amount of balls needed to completely fill the game ending pattern being drawn;

displaying on the video screen any electronic bingo card of any player that has achieved a far-miss bingo progressive, wherein the far miss bingo progressive comprises at least one of no spots covered in the game ending pattern at the time the game ends; only one spot covered in the game ending pattern at the time the game ends;

displaying on the video screen the indicia associated with each of the spaces corresponding to each of the second five of the first group of ten selected electronic bingo balls and each selected bingo ball of the second group of electronic bingo balls;

receiving from the game server indicia associated with a space corresponding to a selected bingo ball of the second five of the first group of ten selected electronic bingo balls, wherein the indicia associated with the space corresponding to the selected bingo ball of the second five of the first group of ten selected electronic bingo balls has been electronically and automatically swapped for the non-selected indicia of the first poker hand and remaining portions of the additional poker hands, and wherein the selected desired indicia kept by the user has been electronically and automatically switched for indicia on the non-first individual electronic bingo cards by electronically and automatically switching locations of the desired indicia kept by the player from an initial location on each non-first individual electronic bingo card to a location indicated by a space on a first individual electronic bingo card corresponding to the desired indicia selected; and displaying on the video screen all poker hands and any winning player indicia combinations, wherein the server of the video gaming system is capable of conducting multiple games simultaneously, each game having its own independent electronic ball draw.

20. The video gaming system of claim 19, wherein electronically swapping non-selected indicia with indicia associated with a space corresponding to a selected bingo ball of the second five of the first group of ten selected electronic bingo balls further comprises electronically swapping non-selected indicia with indicia associated with the space corresponding to the selected bingo ball of the second five of the first group of ten selected electronic bingo balls using a first selected bingo ball of the second five of the first group of ten selected electronic bingo balls first and going in ascending order.

21. The video gaming system of claim 20, wherein electronically swapping non-selected indicia with indicia associated with each said space corresponding to each selected bingo ball of the second five of the first group of ten selected electronic bingo balls further comprises:

electronically swapping a first non-selected indicia with indicia associated with a first space corresponding to a first selected bingo ball of the second five of the first group of ten selected electronic bingo balls;

electronically swapping a second non-selected indicia with indicia associated with a second space corresponding to a second selected bingo ball of the second five of the first group of ten selected electronic bingo balls;

electronically swapping a third non-selected indicia with indicia associated with a third space corresponding to a third selected bingo ball of the second five of the first group of ten selected electronic bingo balls;

electronically swapping a fourth non-selected indicia with indicia associated with a fourth space corresponding to a fourth selected bingo ball of the second five of the first group of ten selected electronic bingo balls; and electronically swapping a fifth non-selected indicia with indicia associated with a fifth space corresponding to a fifth selected bingo ball of the second five of the first group of ten selected electronic bingo balls.

22. The video gaming system of claim 19, wherein the plurality of individual electronic bingo cards comprises three electronic bingo cards, and wherein the plurality of poker hands comprises three poker hands.

23. The video gaming system of claim 19, wherein each electronic bingo card is generated by a random number generator.

24. The video gaming system of claim 19, wherein the program instructions further comprise beginning each game of the multiple games automatically when at least two players have each purchased at least one bingo card within a buy in period.

25. The video gaming system of claim 19, wherein each game comprises at least two players and wherein the at least two players are grouped within one of a single gaming facility and across multiple gaming facilities.

26. The video gaming system of claim 19, wherein in each electronic bingo card each space is defined by a column label and a space number, wherein the space number is randomly selected from a predefined number range for each column numbers 1-13 are randomly assigned to the spaces, numbers 14-26 are randomly assigned to the spaces in a second column, numbers 27-39 are randomly assigned to the spaces in a third column, and numbers 40-52 are randomly assigned to the spaces in a fourth column.

27. The video gaming system of claim 19, wherein the indicia on the secondary poker card overlay is generated by a random number generator.

* * * * *